US008876242B2

(12) United States Patent
Tamaru et al.

(10) Patent No.: US 8,876,242 B2
(45) Date of Patent: Nov. 4, 2014

(54) LIQUID EJECTION HEAD

(75) Inventors: Yuuji Tamaru, Yokohama (JP); Yoshiyuki Imanaka, Kawasaki (JP); Koichi Omata, Kawasaki (JP); Hideo Tamura, Kawasaki (JP); Takaaki Yamaguchi, Yokohama (JP); Kousuke Kubo, Kawasaki (JP); Ryoji Oohashi, Yokohama (JP); Toshio Negishi, Yokohama (JP); Tatsuo Furukawa, Zama (JP); Nobuyuki Hirayama, Fujisawa (JP); Ryo Kasai, Tokyo (JP); Tomoko Kudo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1069 days.

(21) Appl. No.: 12/763,407

(22) Filed: Apr. 20, 2010

(65) Prior Publication Data

US 2010/0283819 A1 Nov. 11, 2010

(30) Foreign Application Priority Data

May 8, 2009 (JP) ..... 2009-113622

(51) Int. Cl.

| | |
|---|---|
| ***B41J 29/38*** | (2006.01) |
| ***B41J 2/05*** | (2006.01) |
| ***B41J 2/045*** | (2006.01) |
| *B41J 2/14* | (2006.01) |

(52) U.S. Cl.

CPC ..... *B41J 2/0458* (2013.01); *B41J 2/04543* (2013.01); *B41J 2002/14387* (2013.01); *B41J 2/04541* (2013.01); *B41J 2/0455* (2013.01); *B41J 2/14088* (2013.01); *B41J 2/04563* (2013.01)

USPC ..... 347/17; 347/60

(58) Field of Classification Search

USPC ..... 347/61–65, 17, 60

See application file for complete search history.

(56) References Cited

U.S. PATENT DOCUMENTS

| | | | | |
|---|---|---|---|---|
| 4,914,562 | A * | 4/1990 | Abe et al. | 347/63 |
| 5,877,785 | A | 3/1999 | Iwasaki et al. | |
| 6,315,396 | B1 * | 11/2001 | Ozaki et al. | 347/60 |
| 7,909,423 | B2 * | 3/2011 | Saikawa et al. | 347/17 |
| 2005/0190232 | A1 | 9/2005 | Lee et al. | |
| 2006/0181571 | A1 | 8/2006 | Iijima | |

FOREIGN PATENT DOCUMENTS

| | | | |
|---|---|---|---|
| JP | 03-005151 | A | 1/1991 |
| JP | 07-125214 | A | 5/1995 |
| JP | 07-125216 | A | 5/1995 |
| JP | 07-148915 | A | 6/1995 |
| JP | 08-216412 | A | 8/1996 |
| JP | 10-000774 | A | 1/1998 |
| JP | 2006-198884 | A | 8/2006 |
| JP | 2006-224444 | A | 8/2006 |

OTHER PUBLICATIONS

Office Action in Chinese Patent Application No. 201010168480.4 dated Dec. 20, 2011.

* cited by examiner

*Primary Examiner* — Uyen Chau N Le
*Assistant Examiner* — John M Bedtelyon
(74) *Attorney, Agent, or Firm* — Fitzpatrick, Cella, Harper & Scinto

(57) ABSTRACT

A print head is provided that well preserves ink characteristics upon printing by way of performing effective ink preliminary heating. The print head has heaters and ejection openings formed at locations corresponding to the heaters. Viewed from the side from which ink is ejected, a sub-heater is established in the print head between the ink supply port and the print elements so as to surround the ink supply port.

13 Claims, 18 Drawing Sheets

LIQUID EJECTION HEAD

BACKGROUND OF THE INVENTION

1. Field of the Invention

The present invention relates to a liquid ejection head that performs printing by ejecting liquid onto a print medium.

2. Description of the Related Art

In recent years ink jet methods are being abundantly adopted in printing apparatus as one of the predominant printing methods. The capability of performing printing without the print head, in the form of a liquid ejection head, contacting the sheet or other print medium, the ease of changing colors, and high quietness are raised as some of the advantages of ink jet methods. Nevertheless, generally, in ink jet printing apparatus based on ink jet printing methods, as the surrounding temperature becomes lower the viscosity of the ink used in printing increases. For this reason, in the case where an ink jet printing apparatus is in an extremely low temperature environment, phenomenon such as the decrease of the volume of the ink ejected from the print head (ejection volume fluctuation), and the non-performance of normal ink ejection (improper ejection) arise. In this case, accompanying the fluctuation in ejection volume, undesirable dot formation and the like, due to density unevenness or improper ejection, can often be seen in the image obtained from printing. In this case there is a possibility that print quality is degraded. In order to eliminate occurrences of such ejection volume fluctuations and improper ejections, heating control is performed in traditional ink jet printing apparatus before the printing operation or during the printing operation such that the print head temperature falls within a prescribed range. As one method of achieving this, heat generation elements (hereinafter called "preliminary heating heaters" or "sub-heaters") are provided in the print head, for heating the ink jet print head. Hence, under low temperature environments the temperature of the ink jet print head and the ink inside the ink jet print head is regulated by driving of the sub-heaters. Regulation of ink jet print head temperature makes it possible to stabilize the volume of ink ejected from the ink jet print head, in this manner.

One example of an ink jet printing apparatus with a sub-heater, serving as a preliminary heater used to control the temperature of the print head, is disclosed in Japanese Patent Laid-Open No. 2006-224444. According to the ink jet printing apparatus disclosed in Japanese Patent Laid-Open No. 2006-224444, in an ink jet print head having at least two nozzle arrays with different ink ejection volumes, a temperature regulation sub-heater is arranged near the nozzle array with the smaller ink ejection volume. From this, it is possible to more responsively control the temperature of the nozzle array with the smaller ejection volume and it's its vicinity, and moreover, without particularly increasing the number of sub-heaters, it is possible to avoid the considerable fluctuation of ink ejection volume caused by increases in ink viscosity and the like.

However, in the case where sub-heaters disclosed in Japanese Patent Laid-Open No. 2006-224444 are deployed in a print head, the sub-heater is arranged at a position separated from the ink supply port on the substrate. Consequently the quantity of heat added to the ink stored inside the ink supply port may be insufficient. Improper ejection may occur as a result due to the commencement of printing with the ink temperature remaining low and ejecting ink with the viscosity remaining high. Furthermore, the case of carrying out heating for a longer time in order to sufficiently increase ink temperature may cause an increase in the total printing time.

SUMMARY OF THE INVENTION

Accordingly, in view of the above considerations, the present invention aims to provide a liquid ejection print head that well preserves ink characteristics upon printing, by the performance of effective preliminary heating of liquid stored inside the liquid supply port.

According to a first aspect of the present invention, there is provided a liquid ejection head, comprising: a liquid ejection head substrate, having a front face having a plurality of print elements for generating energy for ejecting liquid from ejection openings, and provided with a supply port for supplying liquid through the front face and a back face; and a flow path forming member having a plurality of liquid flow path walls in communication with the supply port and each of the plurality of ejection openings, and forming the flow paths by being connected to the liquid ejection head substrate; wherein, viewed from a direction perpendicular to the front face, a preliminary heating element capable of heating liquid inside the plurality of flow paths is established between the plurality of print elements and the supply port so as to surround the supply port.

According to a second aspect of the present invention, there is provided a liquid ejection head, comprising: a liquid ejection head substrate, having a front surface having a plurality of first print elements for generating energy for ejecting liquid from first ejection openings and a plurality of second print elements for generating energy for ejecting liquid from second ejection openings, and provided with a supply port for supplying liquid through the front face and a back face; a flow path forming member having a plurality of liquid flow path walls in communication with the supply port and each of the ejection openings of the plurality of the first ejection openings and the plurality of the second ejection openings, and forming the flow paths by being connected the liquid ejection head substrate; and a preliminary heating element established such as to surround the supply port; wherein the plurality of first print elements are established between the preliminary heating element and the liquid supply port, and the plurality of second print elements are established at a position farther from the supply port than the preliminary heater.

According to the liquid ejection head of the present invention, because it is possible to effectively heat liquid stored inside the liquid supply port, upon printing liquid inside the liquid supply port is supplied to the ejection openings at a satisfactory temperature, and that liquid is ejected from the ejection openings. Therefore print image quality is highly preserved.

Further features of the present invention will become apparent from the following description of exemplary embodiments (with reference to the attached drawings).

DESCRIPTION OF THE EMBODIMENTS

Embodiments of the present invention will be described below with reference to the drawings.

Figure 1:
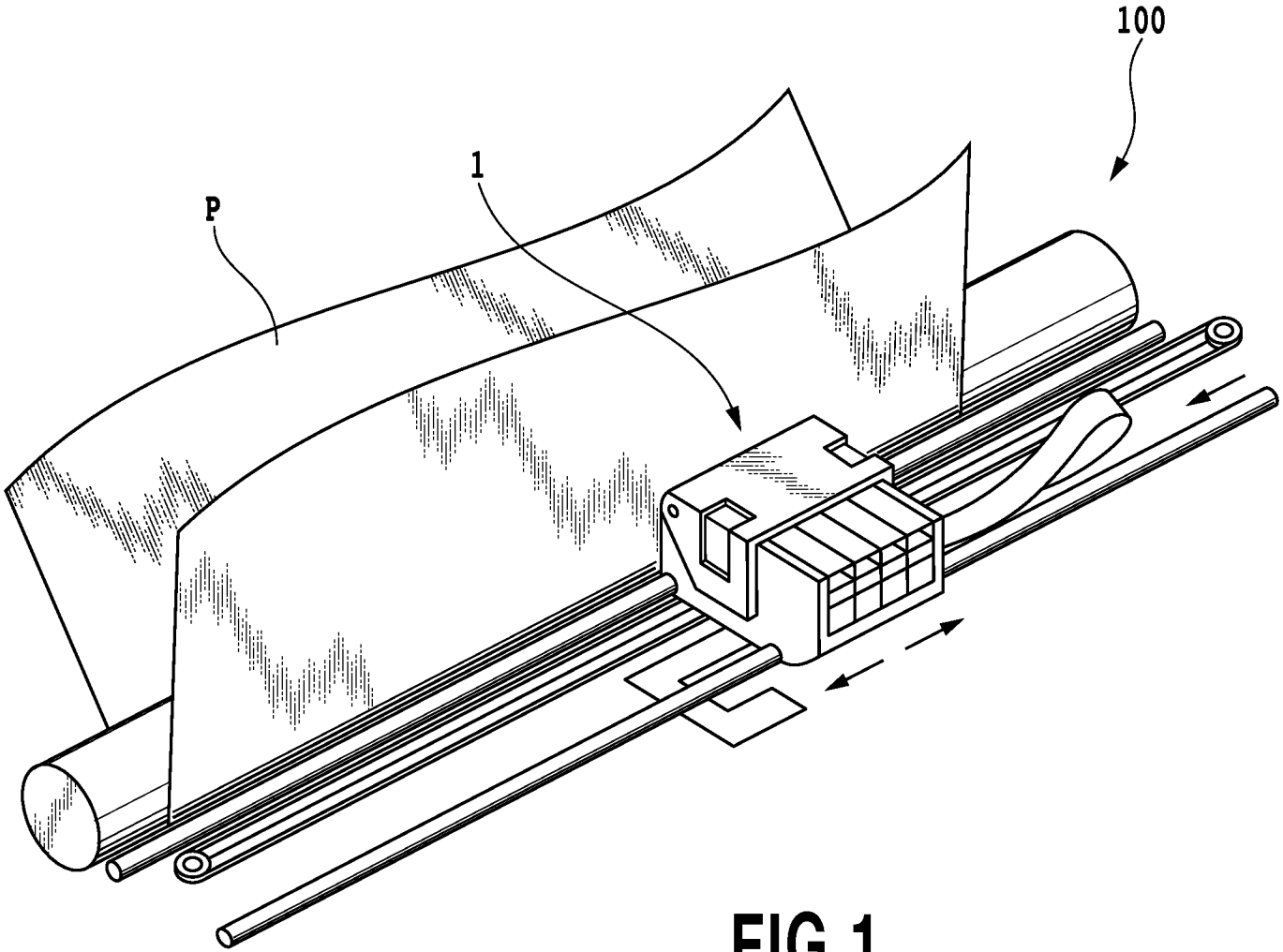
FIG. 1 is a schematically shown perspective view, of an ink jet printing apparatus equipped with the print head of a first embodiment of the present invention.

FIG. 1 is a schematically shown perspective view diagram, of an ink jet printing apparatus 100, which has a print head mounted thereon as the liquid ejection head of a first embodiment of the present invention.

Figure 2:
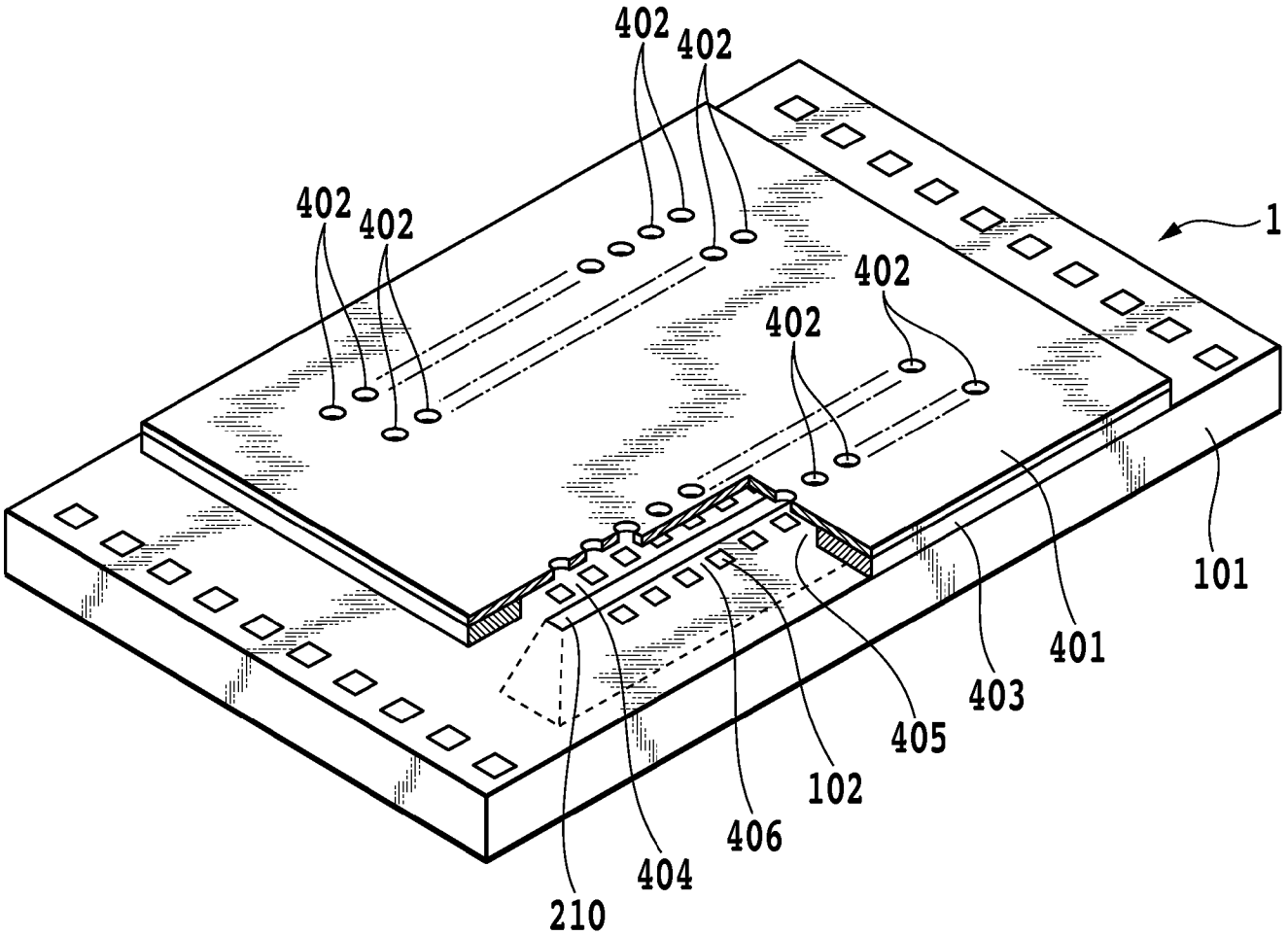
FIG. 2 is a perspective view of the print head equipped in the ink jet printing apparatus of FIG. 1, with a portion shown broken away.

FIG. 2 is a perspective view for explaining an example of the print head 1 (liquid ejection head) used in the ink jet printing apparatus 100 of a first embodiment of the present invention, with a portion shown broken away. The print head 1 used in the ink jet printing apparatus 100 of the first embodiment has bubble forming heaters 102, serving as printing elements, and ejection openings 402 on the face of the orifice plate 401 facing the print medium, at locations corresponding to the bubble forming heaters 102. In the first embodiment a plurality of the ejection openings 402 and bubble forming heaters 102 are formed and arranged. Thus dots are formed on the print medium P by the ejection liquid in the form of ink droplets from the ejection openings 402 by the print head 1 onto the print medium P. The printing of images on the print medium P is performed by forming dots on the print medium P in this manner. As shown in FIG. 2, the print head 1 is formed by joining the orifice plate 401, sandwiching a flow path forming member 403, to the print head substrate 101. The print head 1 has an ink supply port 210 (liquid supply port). Also, the print head 1, has a bubble forming chamber 404 each having ejection opening 402. When ink is supplied to each bubble forming chamber 404, ink is supplied via ink supply ports 210. The ink supply port 210 is formed so as to penetrate the print head substrate 101. The ink supply port 210 is formed such that the width of its opening narrows as heading from the back side of the print head substrate 101 (the upstream side of the ink supply path) towards the surface (the side on which the orifice plate 401 is disposed). The ejection opening arrays of the present embodiment are formed along the ink supply port 210.

A plurality of ink flow paths 405 that communicate with each of the ejection openings 402, and a common liquid chamber 406 that stores ink supplied from the ink supply port 210 and dispenses it to the ink flow paths 405, are defined by the orifice plate 401, flow path forming member 403 and print head substrate 101. As energy activation chambers, bubble forming chambers 404 are formed at the end of each ink flow path 405 on the opposite side of the common liquid chamber side. As for the inside of the bubble forming chambers 404, ink to be ejected is provided by the ink supply port 210 and stored.

The bubble forming heaters 102 are arranged on the print head substrate 101 (liquid ejection head substrate) in 2 lines at a predetermined pitch. The bubble forming heaters 102 are disposed in the bubble forming chambers 404 at a position opposed to the ejection openings, and generate heat energy used to eject ink. The heat energy is imparted toward ink that is stored inside of the bubble forming chambers 404. The ejection openings 402 formed in the orifice plate 401 are formed to correspond to the bubble forming heaters 102 formed in the print head substrate 101. More specifically, the pressure inside the bubble forming chamber 404 increases due to bubble formation pressure resulting from the generation of air bubbles in the bubble forming chamber 404, caused by the addition of heat by the bubble forming heater 102 to the ink inside the bubble forming chamber 404 and film boiling. Kinetic energy is provided to the ink inside the bubble forming chamber 404 and ink is ejected from the ejection openings 402 because of this. In this manner, due to the provision of an electric signal to the bubble forming heater 102, the bubble forming heater 102 is driven, energy is imparted to the ink supplied from the ink supply port 210, ink is ejected from the ejection openings 402 and printing is performed. It should be noted that here the orifice plate 401 and the flow path forming member 403 are made separate members, and the print head substrate 101, the flow path forming member 403 that amounts to a flow path wall, and the orifice plate 401 that amounts to the upper surface of the flow path are established by being joined together. However, it is also possible for it to be created such that the flow path is constructed by joining the print head substrate 101 to a member having a cavity amounting to a section of the flow path; the flow path forming member 403 itself having the ejection openings (taking the flow path forming member and orifice plate as one object).

Figure 3:
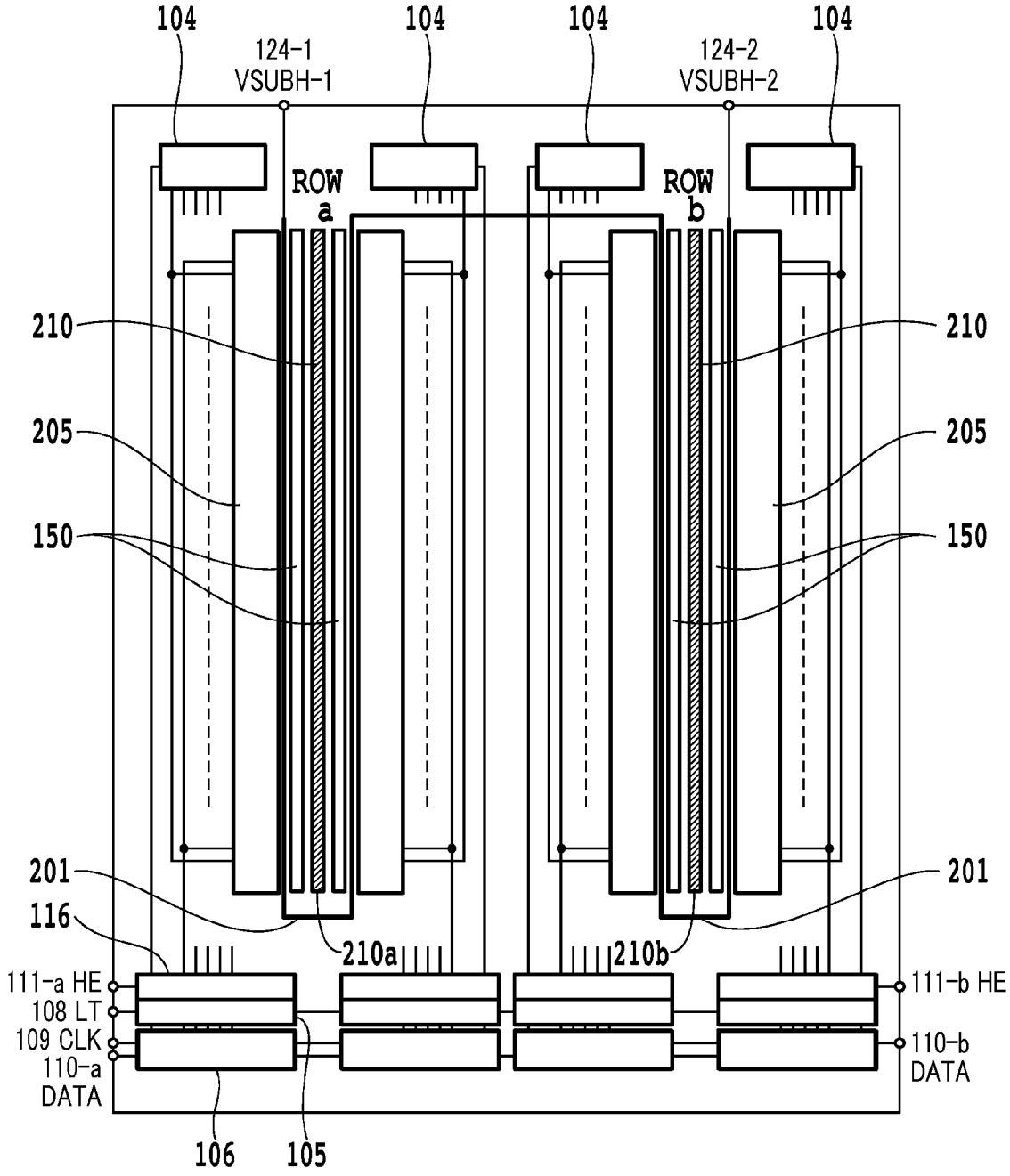
FIG. 3 is an explanatory diagram for explaining the wiring configuration in the print head of FIG. 2.

An explanatory diagram is shown in FIG. 3 for explaining the wiring configuration of the print head substrate 101 of the print head 1 shown in FIG. 2. In the present embodiment, as shown in FIG. 3, two ink supply ports 210 are formed per print head 1. A heater formation region 150 for forming the heaters 102 is formed on both sides of the ink supply port 210 such that the ink supply port 210 is sandwiched therebetween. The heaters 102 are formed within this heater formation region at locations that correspond to the ejection openings. A print element driving circuit 205 provided with a heater selection circuit 115, voltage conversion circuit 107, and switching element 103, is also arranged on the print head substrate 101. In the present embodiment, the print element driving circuit 205 is arranged adjacent to the heater formation region 150 such as to additionally sandwich, from the outside, the heater formation region 150, which sandwiches the ink supply port 210.

An M-bit shift register (S/R) 106, for the temporary storage of print data, is also arranged on the print head substrate 101, outside of the area in which the ink supply port 210 and heater formation region 150 extend. Decoders 104, serving as [[a]] block selection circuits, are also arranged on the print head substrate 101. As discussed below, in the case where printing is performed by time-division driving, the decoder 104 selects a desired block from an N-unit block (group) formed of heaters 102 and switching elements 103. A latch circuit 105 and a heat circuit 116 are arranged between the shift register (S/R) 106 and the print element driving circuit 205. The latch circuit 105 batches and retains print data that has been stored in the shift register (S/R) 106.

Figure 4:
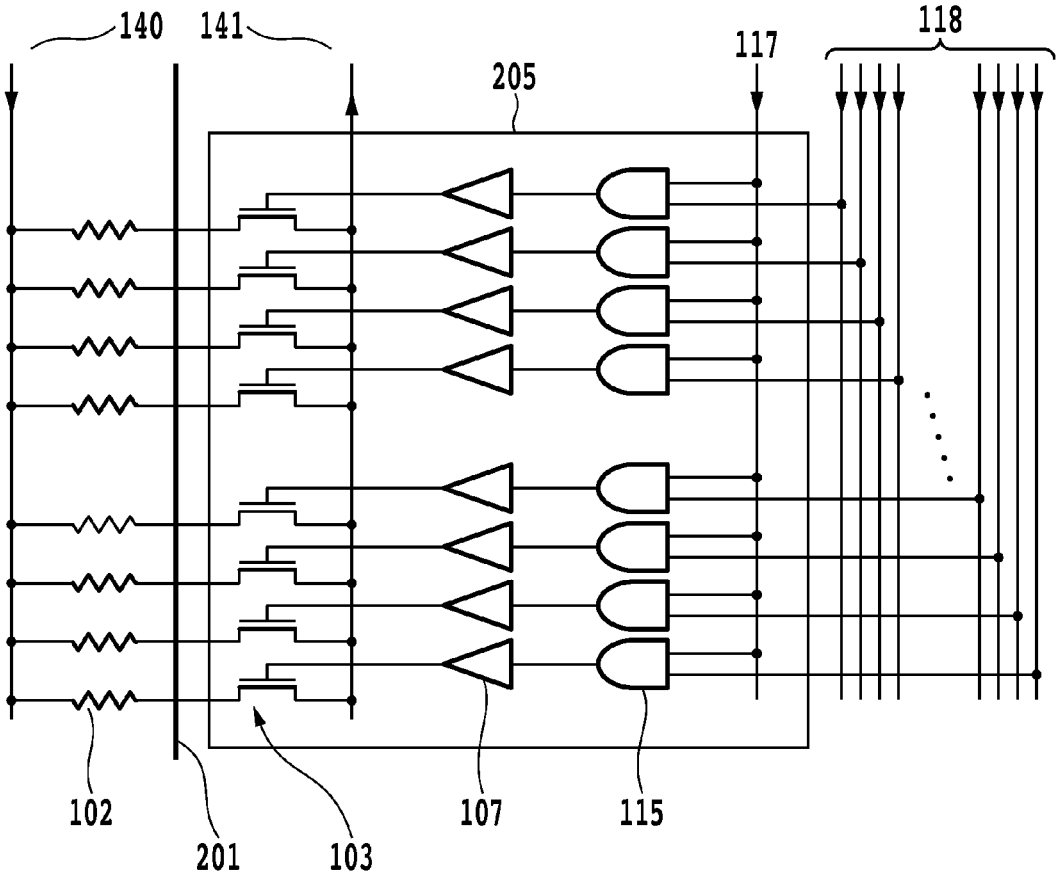
FIG. 4 is an explanatory diagram for explaining the configuration of the print element driving circuit and sub-heater of the print head of FIG. 2.

FIG. 4 is an explanatory diagram, showing in further detail the print element driving circuit 205. The print element driving circuit 205 is provided with switching elements 103, voltage conversion circuits 107 and heater selection circuits 115. The switching elements 103, voltage conversion circuits 107 and heater selection circuits 115 are for selecting a desired heater 102 from among the plurality of heaters formed in the print head, and driving the selected heater 102. Whether each heater 102 is driven is determined by its respective heater selection circuit 115. The output signal from the heater selection circuit 115 is transmitted through the voltage conversion circuit 107 to the switching element 103, and the switching element 103 selectively activates in response to the electric signal from the heater selection circuit such that the electricity is allowed to pass. The switching element 103 that was selected to drive heat generation activates such that the switching element 103 passes electric current. When electric current passes through the switching element 103 due to activation of the switching element 103, electric power is supplied to the heater 102, and the heater 102 is driven. In this manner, a switching element 103 is connected to the heater, which is capable of switching between states of conducting or not conducting an electric signal supplied to the heater. The voltage conversion circuit 107 converts the output signal voltage from the heater selection circuit 115 into a voltage sufficient for driving the switching element 103.

In FIG. 4, 140 denotes a VH power supply line connecting from a VH terminal to the heaters 102, and 141 denotes a GNDH line for recovering electric current that has flown to the heaters 102.

One group is formed of N elements of heaters 102, switching elements 103 and heater selection circuits 115. M units of groups formed of N elements each are formed, divided into groups 1 to M.

In the print head 1 of the present embodiment, as shown in FIG. 3, a sub-heater 201 is arranged as a preliminary heat generation element, for heating the print head substrate 101. Among the ink supply ports 210 shown in FIG. 3, one side is taken as ink supply port 210*a*, and the other side is taken as ink supply port 210*b*. In the present embodiment, one continuous sub-heater is disposed on the print head substrate 101, along locations adjacent to the ink supply port 210*a* and ink supply port 210*b*, such as to surround three sides of the ink supply port 210 configured in a rectangular shape. The electrode at one end of the one long sub-heater is connected to a sub-heater power supply terminal VSUBH-1 at a location close to ink supply port 210*a*, and the electrode at the other end is connected to a sub-heater power supply terminal VSUBH-2 at a location close to ink supply port 210*b*. Here, the sub-heater power supply terminal VSUBH-1 and the sub-heater power supply terminal VSUBH-2 are established on the same side of the print head substrate. Sub-heater 201 is arranged along ink supply port 210 in this manner.

Figure 5A:
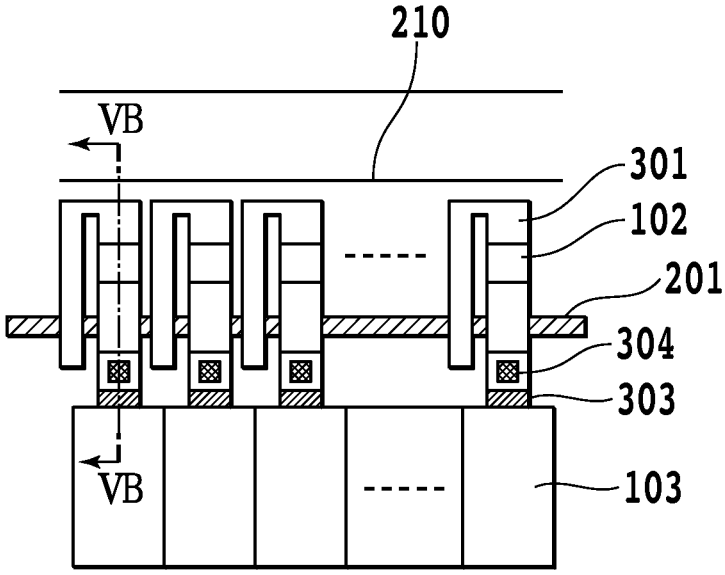
FIG. 5A is an enlarged plan view in the area of periphery of the heater of the print head substrate used in the print head of FIG. 2.
Figure 5B:
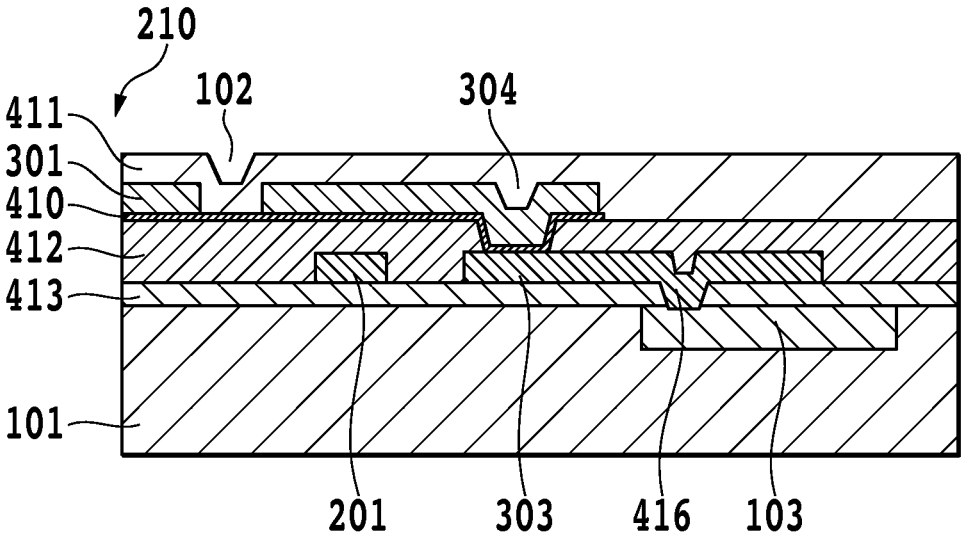
FIG. 5B is across sectional view taken along the line VB-VB of FIG. 5A.

The sub-heater 201 is arranged such that it passes through the space between the ink supply port 210 and switching element 103, when a plan view of the print head 1 is made from ink-ejection side. Particularly in the present embodiment as shown in FIGS. 5A-5B, the sub-heater 201 is disposed between each of the opposing heaters 102 sandwiching the ink supply port 210 and the print element driving circuit 205. Thus the sub-heater 201, formed of one continuous conductive line, is arranged such as to surround the perimeter of the ink supply port 210.

The sub-heater 201 is arranged such as to surround the perimeter of the ink supply port 210 in the above manner. Therefore the sub-heater 201 can effectively add heat to the ink stored in the ink supply port 210. Moreover, the entire print head substrate 101 can be more evenly heated compared to print heads in the prior art where the sub-heater is arranged in a portion neighboring the outer side of the substrate. The sub-heater 201 is formed of a conductive layer. As for the materials composing the sub-heater 201, Al (aluminum) or the like, for example, can be utilized as a resistive element. Both ends of the sub-heater 201 formed by Al or the like are each connected to the sub-heater power supply terminal 124 (VSUBH). Thus by the application of an appropriate voltage between these two ends, the sub-heater 201 can generate heat and heat the entire head substrate. Hence, the sub-heater 201 can appropriately perform temperature regulation of the head substrate. Furthermore, because the sub-heater 201 and ink supply port 210 are adjacent, the sub-heater 210 can effectively heat the ink fluid supplied from the ink supply port 210. Therefore the sub-heater 201 can more satisfactorily perform temperature regulation of the ink inside of the ink supply port 210.

A schematically shown enlarged plan view, of the conductive lines of the print head 1, is shown in FIG. 5A and a schematically shown cross-sectional view, taken along the line VB-VB of FIG. 5A is shown in FIG. 5B. The positional relationship between the heater 102, sub-heater 201, and switching element 103 will be explained while making use of FIGS. 5A and 5B.

A schematic plan view is shown in FIG. 5A of a print head that has Al, serving as a sub-heater 201, passing between the heaters 102 and switching elements 103. A section of a heater driving circuit pertaining to a plurality of heaters is enlarged and shown in FIG. 5A. A cross-sectional view taken along the line VB-VB of FIG. 5A is shown in FIG. 5B. As shown in FIG. 5B, an inter-layer insulation film 413 is formed on top of the substrate 101, in which the switching element 103 is buried. The sub-heater 201 and second conductive layer 303 are formed on top of the inter-layer insulation film 413, and an inter-layer insulation film 412 is formed on top of that. A heater layer 410 is also formed on top of the inter-layer insulation film 412, and a first conductive layer 301 is formed on top of the heater layer 410. A protective film is formed on top of the first conductive layer 301.

Due to selective elimination of the first conductive layer 301, the heater layer 410 is exposed at a section where the first conductive layer 301 is not formed. At the removed section of the first conductive layer 301, the electric current flowing in the first conductive layer 301 temporarily goes through the heater layer 410, which has a comparatively high resistance, and again flows into the first conductive layer 301 when it reaches the point where it is directly under the portion where the first conductive layer is formed, and from there goes through the inside of the first conductive layer 301. The electric current generates heat when it goes through the heat layer 410.

The first conductive layer 301 and second conductive layer 303 are connected via a through-hole 304. At the sections other than the section where the through-hole 304 is formed, an inter-layer insulation film 412 is formed in between the first conductive layer 301 and the second conductive layer 303, and is formed such that electricity is not conducted between the first conductive layer 301 and the second conductive layer 303. A through-hole 416 is also formed in the interval between the second conductive layer 303 and the switching element 103 buried in the substrate 101 in order to electrically connect them. Again, as shown in FIGS. 5A-5B, when viewing the print head substrate 101 from the ink ejection side, the sub-heater 201 is arranged in the interval between the heater 102 and the switching element 103. In the direction that ink is ejected (viewing from a direction perpendicular to the face on which the print head's printing elements are established), the sub-heater 201 is positioned further behind the heater 102. Because of this, it is possible to attain miniaturization of the print head substrate 101 due to the effective utilization of dead space that has hitherto not been used.

Figure 6:
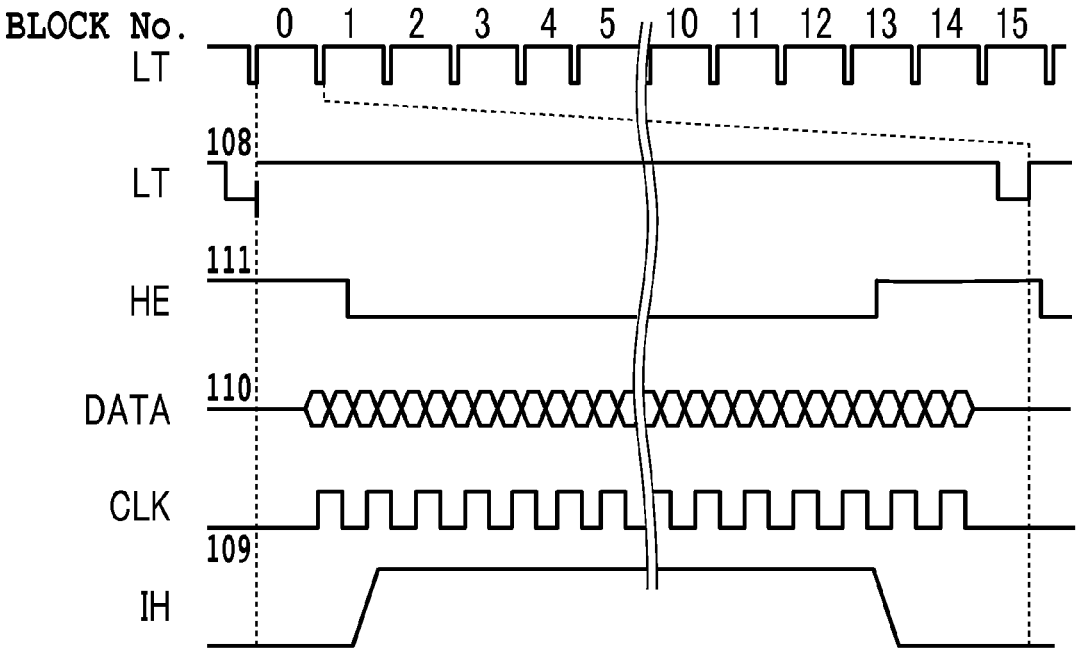
FIG. 6 is a timing chart for explaining the series of operations of the driving circuit upon driving of the heater in the print head of FIG. 2.

A timing chart is shown in FIG. 6 for explaining the series of operations of the driving circuit, upon driving the heater 102. The timing chart of FIG. 6 corresponds to 1 sequence (1 ejection cycle), in which a desired heater is picked out from among M by N heater units, and selected one time. That is, 1 cycle is made until the same heater is capable of being driven again.

As shown in the chart of FIG. 6, the clock signal CLK supplied from the print apparatus main body is input into the terminal 109. When printing is performed, a serial transferred M-bit print data signal DATA is input into the shift register 106 from the terminal 110, and stored sequentially. In accordance with the latch signal LT input from the latch signal terminal 108, this serial data is retained in the latch circuit. At this time the signal input into the block selection circuit 104 is also serially transferred following the print head signal, converted into an N block selection signal by a decoder, and attached to groups 1 to M. By the above configuration, M print data signals and N block selection signals are subject to logical disjunction in a matrix by the heater selection circuit 115, and heaters to be driven are selected from among the M by N heaters 102.

First, print data compliant M-bits of data is serially transferred to the shift register by the DATA signal contemporaneous with the clock signal CLK, and then the data is parallel transferred to the latch circuit. When the following latch signal LT turns to "Lo" (low level), the input data is transmitted and output to data line 117, and when the following latch signal LT turns to "High" (high level), this signal is retained. Among the M data signals 117, print data complaint desired data signals turn to "High".

In the same manner, the X bit block control signal is also serially transferred to the shift register contemporaneously with the clock signal CLK, and parallel transferred to the latch circuit. Then, when the following latch signal LT turns to "High" the X bit block control signal is retained in the decoder. When any one output is selected from the decoder among the N outputs of the block selecting signal 118, it turns to "High".

A desired heater is selected by a AND circuit of the heater selection circuit 115 from among M driving circuits commonly connected to the block selection signal. As for the selected heater, in accordance with the signal taken from the AND of the HE signal input from the terminal 111 and the print data signal input from the heat circuit 116, electric current IH flows and heaters are driven.

By sequentially repeating an operation similar to the one above N times, M by N heaters are time division driven under a timing whereby M units are driven N times each, and all of the heaters can be selected in accordance with the image data.

More specifically, M by N heaters, divided into M groups composed of N heaters per group, are driven under a timing whereby the time of one sequence is time divided by N such that 2 or more heaters within the same group are not driven at the same time. The print head is controlled such that M-bit of image data is driven simultaneously.

Figure 7:
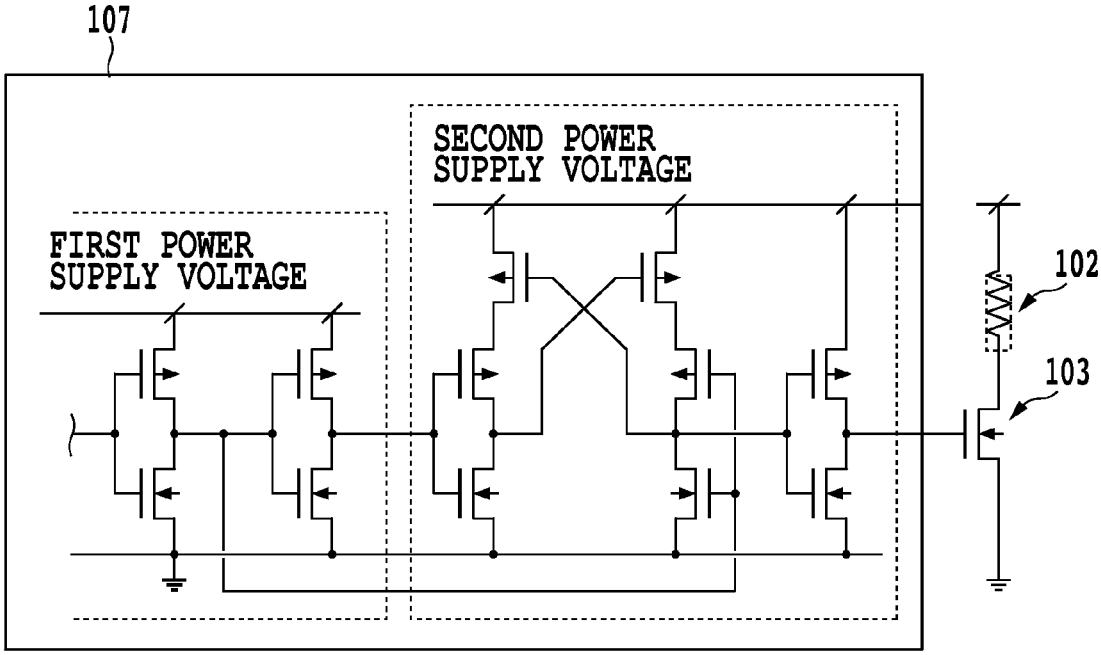
FIG. 7 is an explanatory diagram for explaining the voltage conversion circuit used in the print element driving circuit of FIG. 4.

In FIG. 4, the block selection signal 118 and print data signal 117 are input into the heater selection circuit 115, which serves as a AND gate. In the case where these two signals jointly become active, the output of the AND gate becomes active. This section's circuit diagram is shown in FIG. 7. Due to the voltage conversion circuit 107, the voltage magnitude of the output signal of the AND gate of FIG. 7 is converted to a higher voltage (second power supply voltage) than the voltage magnitude of the output of the heater selection circuit (first power supply voltage). The converted signal is applied to the gate of the switching element 103, which is a MOS transistor. When voltage is applied to the gate of the switching element 103, electric current passes into the heater 102 connected to the switching element 103, and the heater 102 is driven.

Here, because the electric signal is to be applied to the gate of the switching element 103, the input electric signal is converted to a higher voltage by the voltage conversion circuit 107. Herewith the on-resistance at the switching element 103 is lowered, allowing for current to flow in the heater at a high efficiency. At this time, it is preferable to establish the voltage level of the raised power supply voltage to the maximum extent without surpassing the circuit's breakdown voltage or the MOS gate breakdown voltage.

In this manner, by way of selectively dispatching electric signals to the heater 102, it is possible to selectively drive the heater 102. Hence it is possible to reduce the number of nozzles that are simultaneously driven, suppress fluctuations in the driving voltage, and stably eject ink.

As for the print head 1 of the present embodiment, the sub-heater 201 is arranged between the ink supply port 210 and the switching element 103. Consequently the sub-heater 201 is positioned near the ink stored in the ink supply port 210. Because of this, it is possible to effectively heat ink stored in the ink supply port 210 from a position near the ink supply port 210. As a result, when ink is ejected it is possible to bring it to a state where its characteristics are more suitably in accordance with the requirements at that time. Also, because ink ejection is carried out at time when ink characteristics have been brought to a more suitable state, the occurrence of ejection defects is suppressed and ink ejection is carried out more reliably. Because of this, it is possible to attain improvement of ink ejection performance and print image quality. Also, because it is possible to effectively heat the ink inside the ink supply port 210, bringing ink stored inside the ink supply port 210 to a suitable temperature can be completed in a short time. Therefore it is possible to shorten the time it takes to print.

Also, as shown in FIG. 5B, in the present embodiment, the sub-heater layer 201 is arranged above the inter-layer insulation film 413 in the same manner as the second conductive layer 303 connecting the interval between the through hole 304 and the switching element 103. Therefore, in the case where the sub-heater 201 and the second conductive layer 303 are formed from the same material, it is possible to form them together in the same process. Because it is possible abridge the manufacturing process due to the simultaneous formation of the sub-heater 201 and the second conductive layer 303 in this manner, it is possible to shorten the time it takes to manufacture the print head. Also, it is possible to keep the print head manufacturing cost down.

Also, as for the present embodiment, by way of the print head 1 being formed as mentioned above, the section where switching elements and the like are embedded is formed without being arranged beneath the sub-heater 201. Therefore, it is possible to make a structure that curbs the occurrence of bump that can arise in the case where switching elements and the like are built into a layer directly under the sub-heater 201. Because of this, the membrane thickness of the Al that forms the sub-heater 201 becomes uniform across the entirety of the print head substrate 101. Therefore, it is possible to suppress the occurrence of disconnection due to electromigration or the like in the conductive layer. In this manner, because the membrane thickness of the sub-heater 201 becomes uniform, it is possible to suppress the occurrence of disconnection and the like, and improve the durability of the sub-heater 201.

The second embodiment will be explained next using FIG. 8. It should be noted that the figures will be coded in the same manner and explanations omitted with respect to sections that are configured in the same manner as the first embodiment above, and explanations will be given only with respect to sections that differ.

Figure 8:
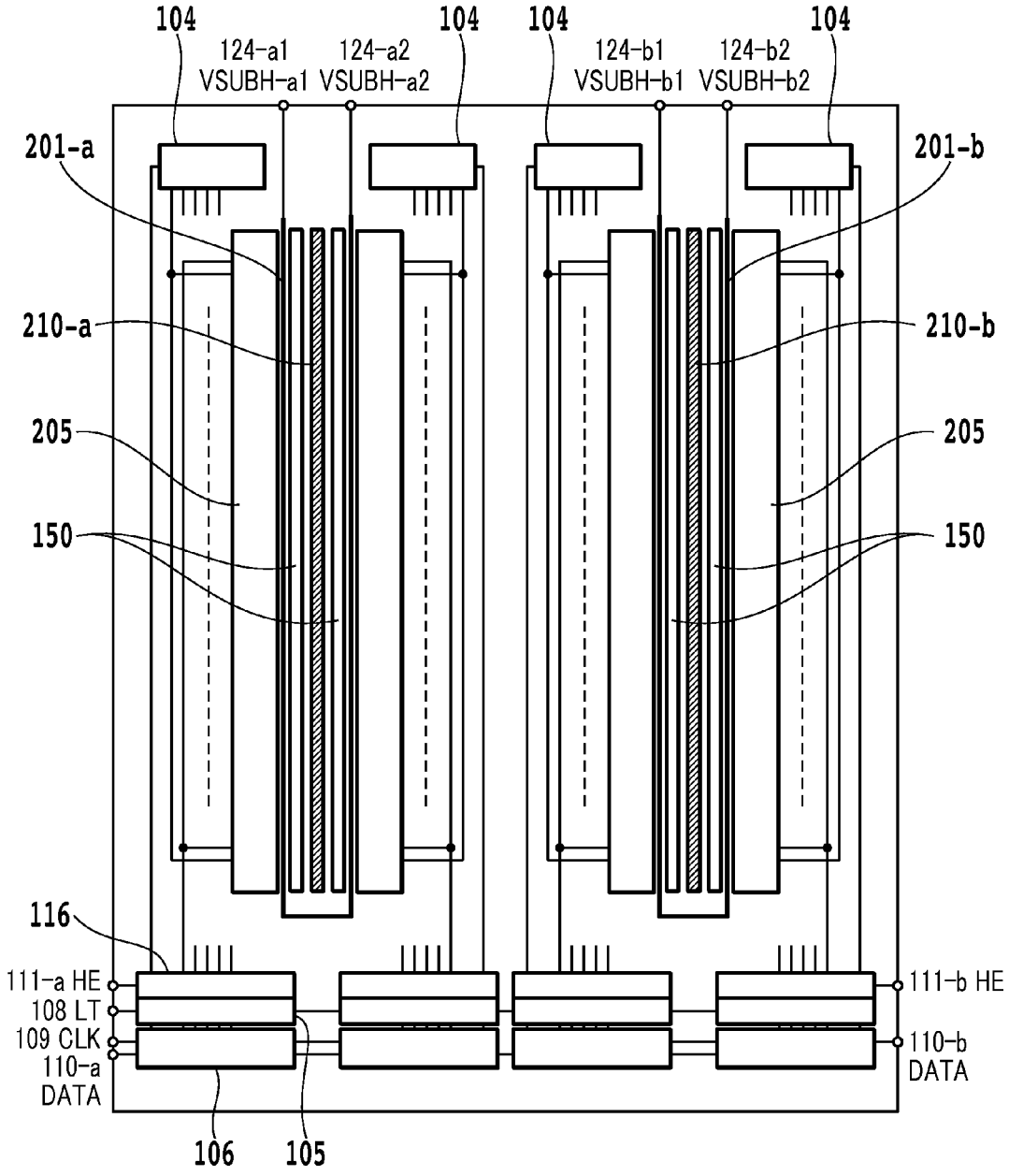
FIG. 8 is an explanatory diagram for explaining the wiring configuration in the print head of a second embodiment of the present invention.

The print head of the second embodiment shown in FIG. 8 has 2 ink supply ports 210-*a* and 210-*b*. A sub-heater 201 is disposed around the perimeter of the ink supply port such as to surround three sides of the ink supply port 210 configured in a rectangular shape. In the present embodiment, the sub-heater that is arranged adjacent to the ink supply port 210-*a* is taken as sub-heater 201-*a* and the sub-heater that is arranged adjacent to the ink supply port 210-*b* is taken as sub-heater 201-*b*. Print data input terminals are taken as 110-*a* and 110-*b*, and heat signal terminals are taken as 111-*a* and 111-*b*, corresponding to each. Thus, in the present embodiment, for each ink supply port 210 the independent sub-heaters 201-*a* and 201-*b* are arranged in a band shape such as to surround the perimeter of the ink supply port 210, when the print head 1 is viewed from a direction perpendicular to the face on which the heater 102 is established. Sub-heater power supply terminals 124-*a*1 and 124-*a*2, and 124-*b*1 and 124-*b*2 are also individually established, corresponding to the respective sub-heaters 201-*a* and 201-*b*. It should be noted that two pairs of sub-heater power supply terminals, each corresponding to one sub-heater, are respectively established on the same side of the print head substrate.

As for print heads in general, different color ink is ejected from different ink supply ports. Ink characteristics and viscosity differ depending upon the color of the ink. In the present embodiment, in order to regulate to suitable temperatures according to the ink characteristics differing by color in this manner, the print head is configured such that it is possible to individually and independently control temperature with respect to each ink supply port. Also, print head temperature is not constant at every location, but rather there are cases where the temperature is different at each area of the print head. According to the present embodiment, even if temperature differs at each area of the print head, it is possible to carry out temperature control at each area in accordance with the temperature distribution at each area of the print head.

In the present embodiment the print head has multiple ink supply ports, the ink supply ports having respective sub-heaters 201-*a* and 201-*b*, which can be temperature regulated independently. Therefore, for each ink supply port 210-*a* and 210-*b*, it is possible to regulate the temperature of the sub-heaters 201-*a* and 201-*b* to a temperature suitable for the ink stored in each ink supply port 210. Hence it becomes possible to more finely control the temperature of the ink stored in the ink supply port 210.

It should be noted that although the present embodiment was described by making use of the case of a print head with two sub-heaters 201-*a* and 201-*b*, more sub-heaters than this may also be established. In that case it is also possible to independently control each sub-heater by the establishment of sub-heater power supply terminals corresponding to each ink supply port.

The third embodiment will be explained next using FIGS. 9 to 11A-11B. It should be noted that the figures will be coded in the same manner and explanations omitted with respect to sections that are configured in the same manner as the first and second embodiments above, and explanations will be given only with respect to sections that differ.

In the print heads of the first and second embodiments, the sub-heaters are positioned between the heater and switching element, viewed from the side from which ink is ejected. On the other hand, the print head of the third embodiment differs from the first and second embodiments in that the sub-heater, viewed from the side from which ink is ejected, is arranged in between the ink supply port and the heater.

Figure 9:
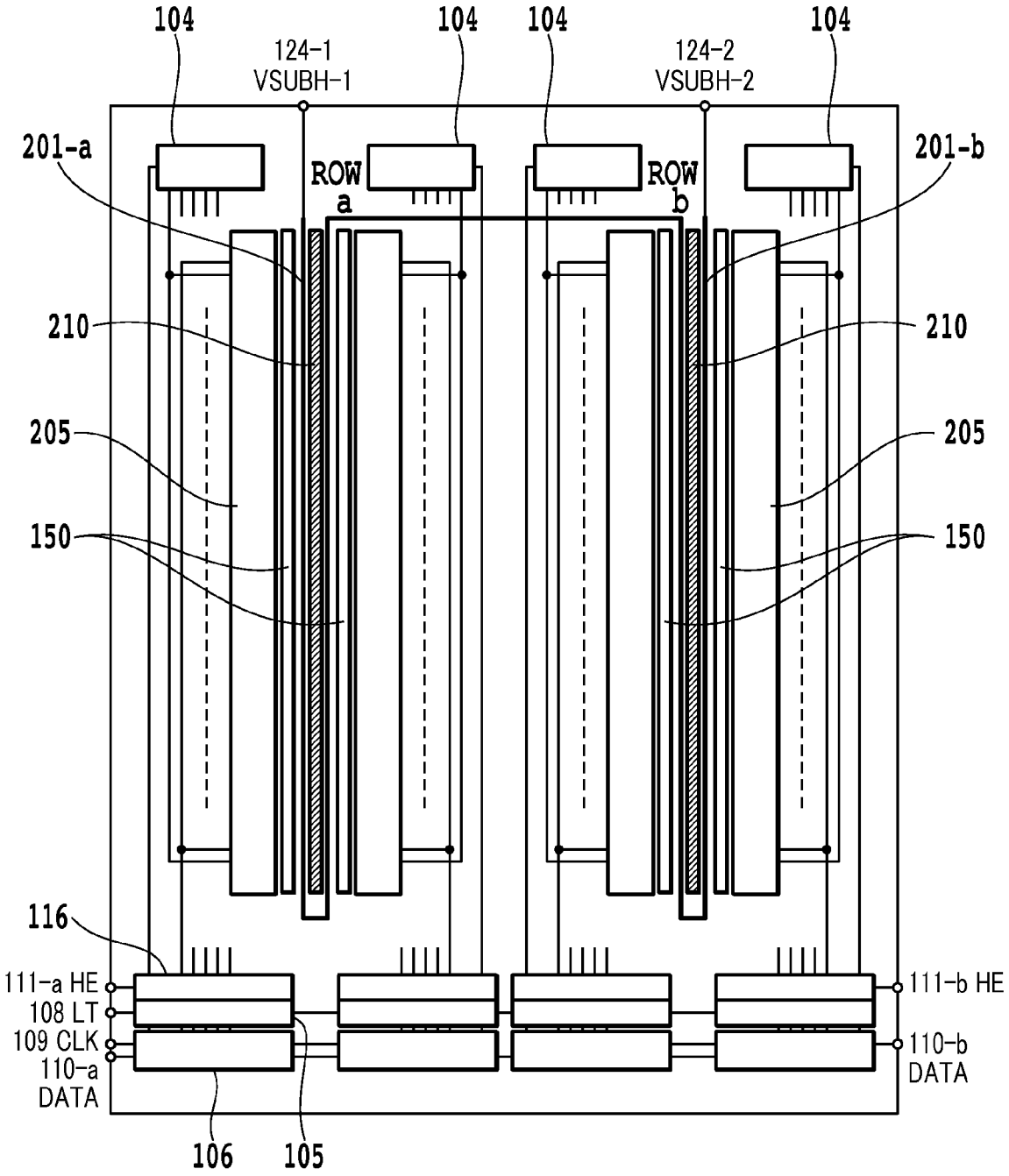
FIG. 9 is an explanatory diagram for explaining the wiring configuration in the print head of a third embodiment of the present invention.
Figure 10:
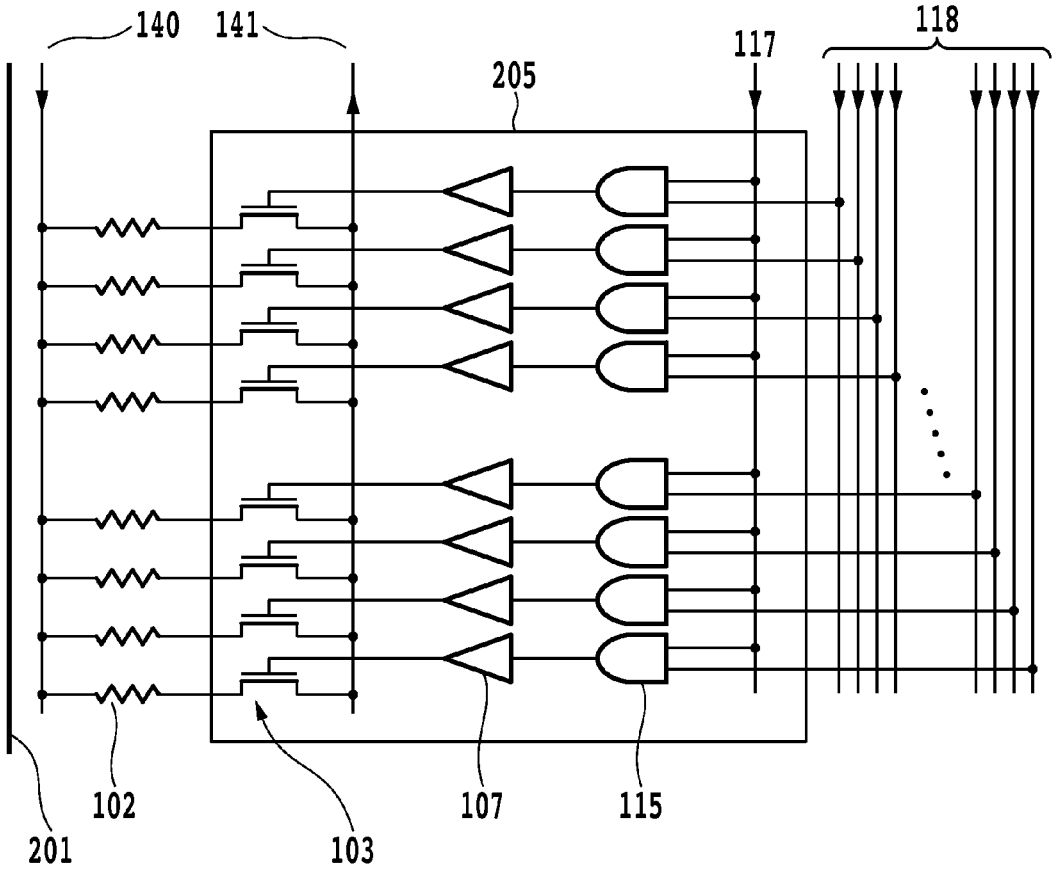
FIG. 10 is an explanatory diagram for explaining the configuration of the print element driving circuit and sub-heater in the print head of FIG. 9.
Figure 11A:
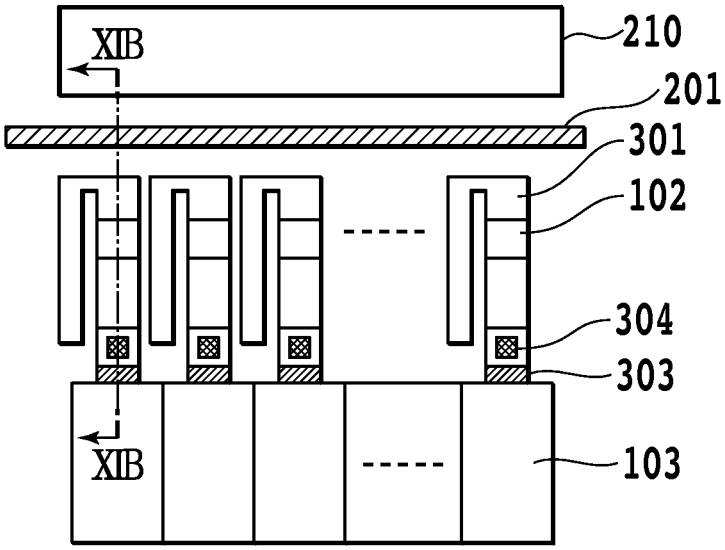
FIG. 11A is an enlarged plan view in the area of periphery of the heater of the print head substrate used in the print head of FIG. 9.
Figure 11B:
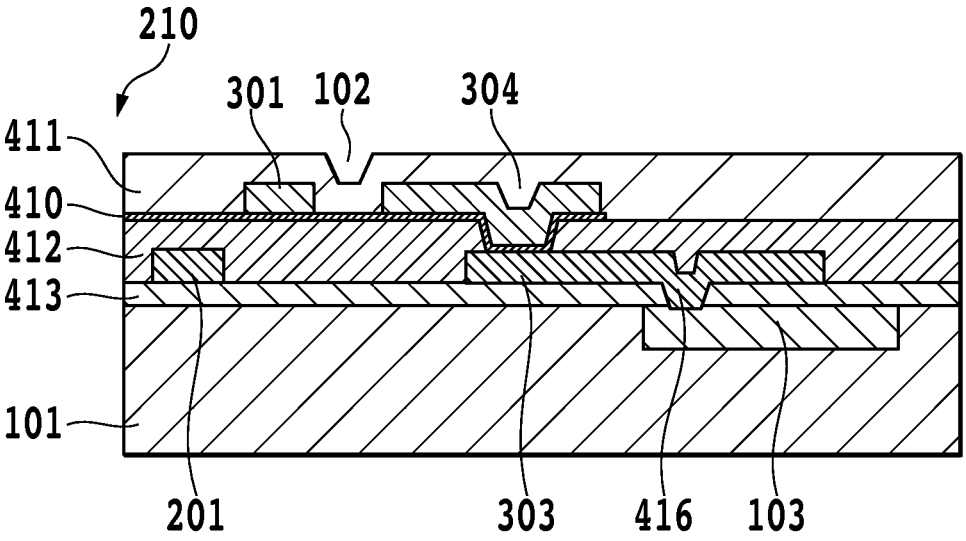
FIG. 11B is a cross sectional view taken along the line XIB-XIB of FIG. 11A.

FIG. 9 shows a schematic plan view, with the wiring configuration of the substrate used in the print head of the third embodiment shown. In FIG. 9 as well, two ink supply ports 210 are formed in the print head. The heater and print element driving circuit are enlarged, and an explanatory diagram for explaining the wiring in that vicinity is also shown in FIG. 10. A schematic plan view is shown in FIG. 11A, showing the positional relationship between the heater 102, sub-heater 201, and switching element 103. A cross sectional view taken along the line XIB-XIB of FIG. 11A is again shown in FIG. 11B.

As shown in FIGS. 9, 10, 11A and 11B, viewed from the side from which ink is ejected (viewing the print head 1 from a direction perpendicular to the face on which the heaters 102 are established), the sub-heater 201 is formed in a band shape between the ink supply port 210 and the heater formation region 150 that forms the bubble forming heaters 102, such as to surround the perimeter of the ink supply port 210. Furthermore, viewing the print head 1 from a direction perpendicular to the face on which the heaters 102 are established, the sub-heater 201 is arranged such that it is located on the underside of the flow path in communication with the ejection openings 402 and ink supply port 210. Therefore the sub-heater 201 is brought further to and arranged near the ink supply port 210. Hence temperature regulation of ink stored in the ink supply port 210 and ink stored in the flow path is performed, and it is possible to degrade viscosity of ink and highly preserve print image quality.

The fourth embodiment will be explained next using FIGS. 12 to 16A-16B. It should be noted that the figures will be coded in the same manner and explanations omitted with respect to sections that are configured in the same manner as the first through third embodiments above, and explanations will be given only with respect to sections that differ.

In the print head of the first through third embodiments, an array of ejection openings at equal distances from the ink supply port is aligned on one side of the ink supply port, parallel to the direction in which the ink supply port extends. On the other hand, in the print head 4 of the fourth embodiment, ink ejection openings are alternately staggered at differing distances from the ink supply port.

Figure 12:
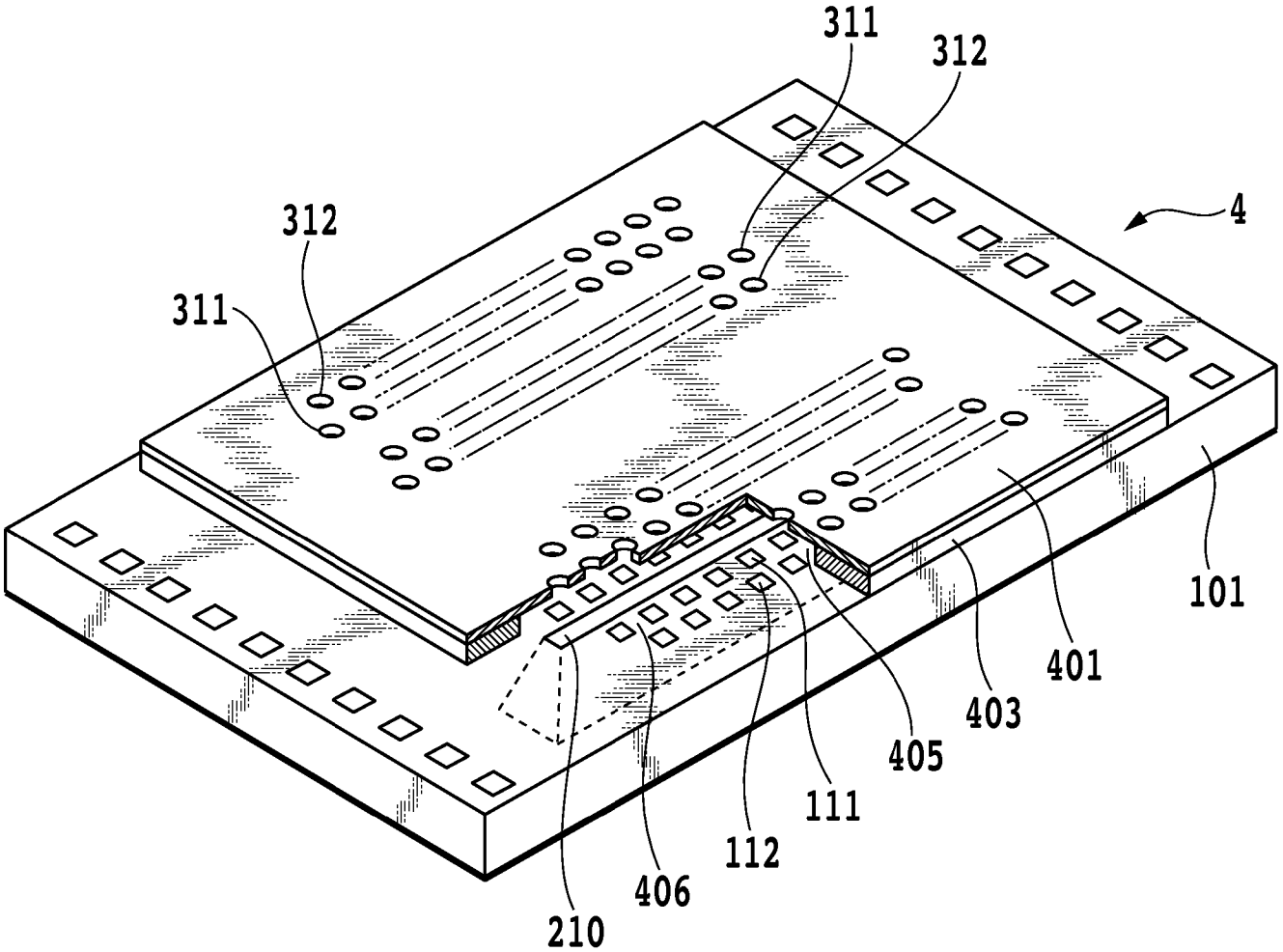
FIG. 12 is a schematically shown perspective view, of a print head equipped in the ink jet printing apparatus of a fourth embodiment of the present invention.
Figure 13:
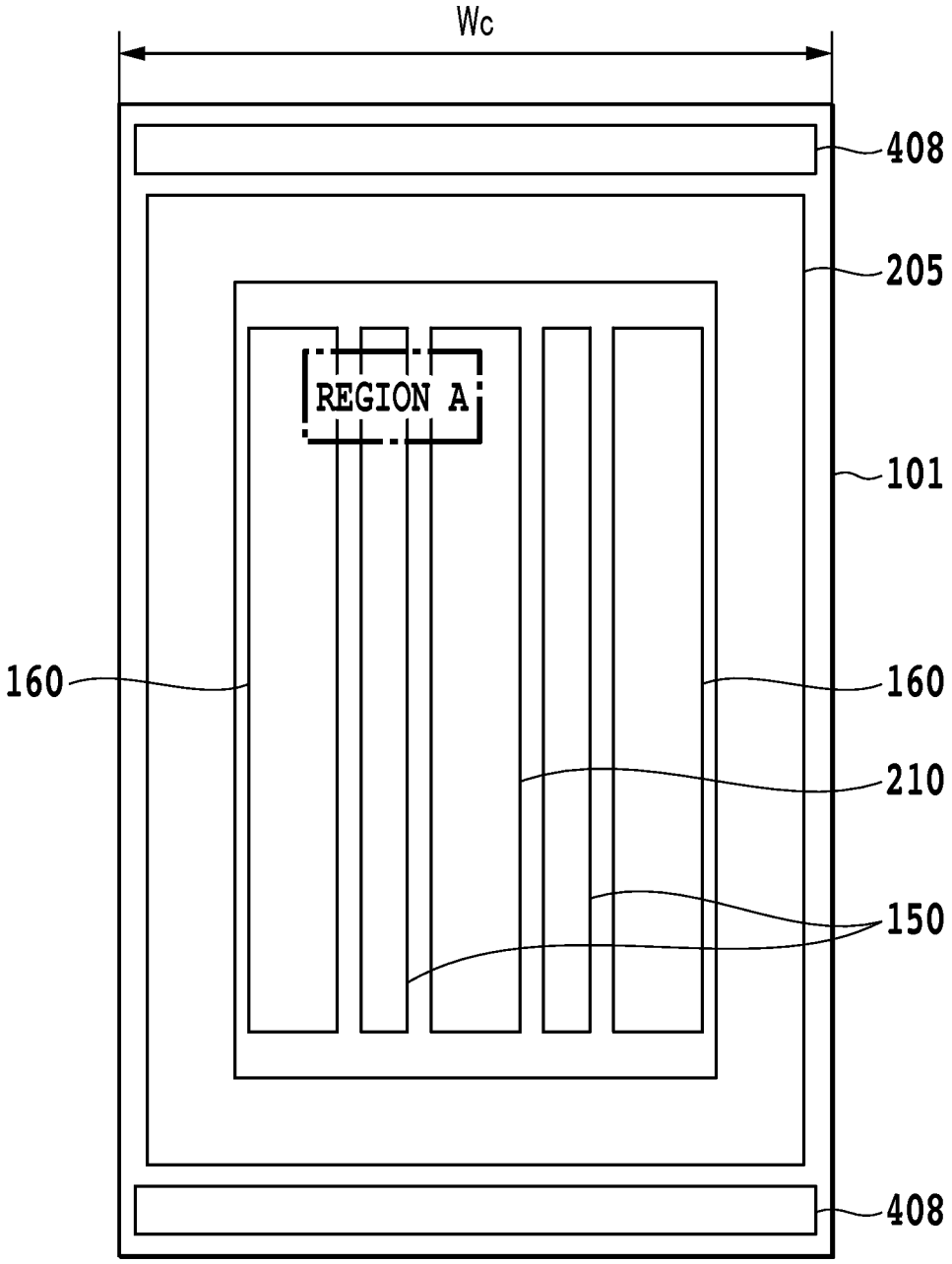
FIG. 13 is a schematic plan view, of a print head substrate, for explaining the positional relationship of the components arranged on the print head substrate of the print head of FIG. 12.

A perspective view of the print head of a fourth embodiment is shown in FIG. 12. As shown in FIG. 12, in the print head 4 of the fourth embodiment, two types of ejection openings are formed on one side of the ink supply port 210: ejection openings at a comparatively short distance from the ink supply port, and ejection openings at a comparatively long distance from the ink supply port. In FIG. 13, a schematic plan view of a print head substrate 101 used in the ink jet print head 4 of the fourth embodiment is shown. An ink supply port 210 that penetrates through the substrate 101 is also formed in the same manner in the print head substrate 101 used in the print head 4 of the present embodiment.

The print head 4 of the present embodiment, as shown in FIG. 13, has a bubble forming heater formation region 150 that has bubble forming heaters 111 and 112 arranged along the ink supply port 210 to form bubbles in the ink. Also, in addition to this, it also has a switching element forming area 160 with switching elements 103 arranged for driving the bubble forming heaters 111 and 112, and a print element driving circuit 205 for driving the above switching element. At the edge towards the area to which the ink supply port 210 extends on the print head substrate 101, an electrode pad forming area 408 is formed, which forms electrode pads that electrically connect the print head substrate 101 and a controller arranged at an exterior of the print head substrate 101. The width of the print head substrate 101 used in the print head of the present embodiment is Wc.

Figure 14A:
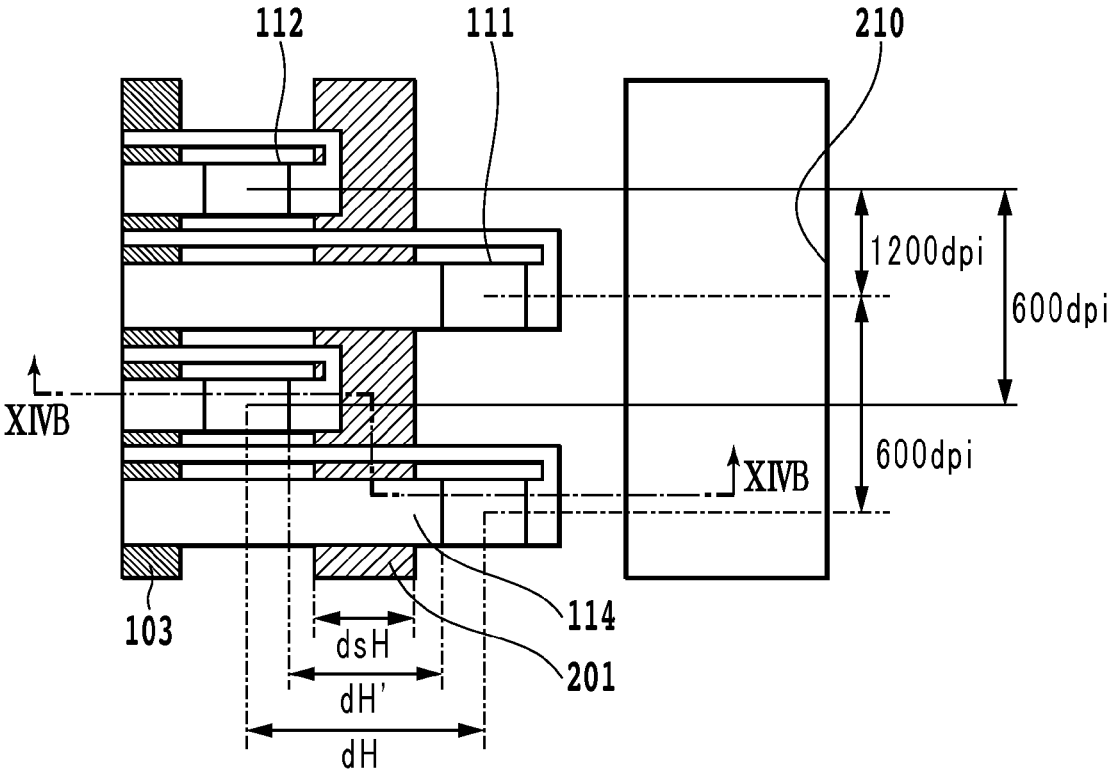
FIG. 14A is an enlarged schematic plan view, in the area of periphery of the heaters of the print head substrate in the print head of FIG. 12, for explaining the position of the sub-heater.

FIG. 14A is an enlarged plan view showing the region A of FIG. 13, with the vicinity of the heater section of the print head substrate 101 used in the print head 4 enlarged. As shown in FIG. 14A, two rows of bubble forming heaters 111 and 112 that have a 600 dpi pitch are formed in the print head 4, on one side of the ink supply port 210. As for these ejection opening arrays, the ejection openings of each array are formed such that they deviate by a half pitch portion. That is, the ejection openings 311 and 312 are arranged on one side of the ink supply port 210 staggeredly in two rows, and deviate by 1200 dpi in the direction in which the ink supply port 210 extends. As for each of the bubble forming heaters 111 and 112, the distance between the centers of the respective bubble forming heaters is taken as dH. Also, the distance between the edges of each bubble forming heater 111 and 112 on the mutually closest sides to one another is taken as dH'. Here, the sub-heater 201 is arranged in the interval between the bubble forming heaters, and the heaters are formed such that the sub-heater width WsH satisfies the relationship dH'>WsH.

Figure 14B:
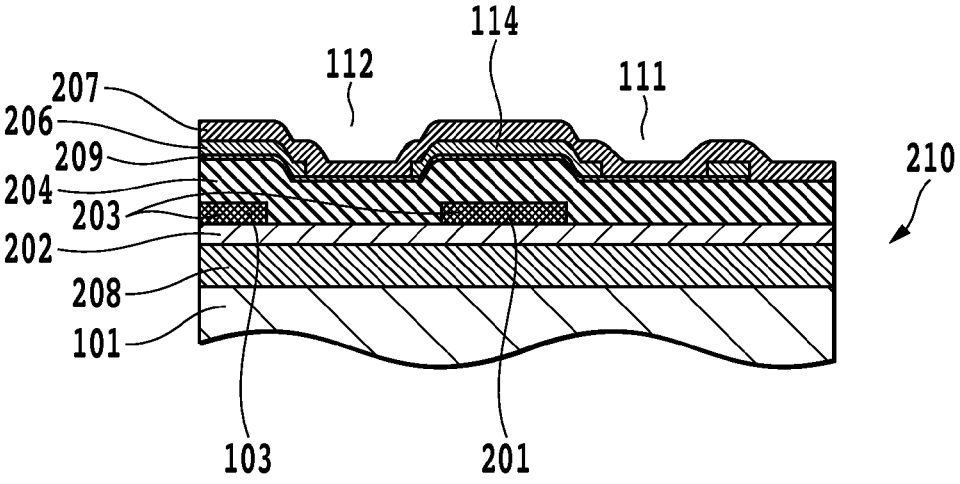
FIG. 14B is a cross sectional view taken along the line XIVB-XIVB of FIG. 14A.

FIG. 14B is a cross sectional view taken along the line XIVB-XIVB of FIG. 14A. A SiO field thermal oxidation film 208, which is a heat storage layer, is formed above the Si substrate 101 serving as a print head substrate, and a BPSG 202 serving as a first insulation layer is formed above the heat storage layer 208. Above the insulation layer BPSG 202, one section of a switching element, and a first Al conductive layer 203 that functions as a sub-heater are formed by patterning. Moreover, a plasma SiO 204, which is a second insulation layer, is arranged above BPSG 202 and Al conductive layer 203, and above that a TaSiN heater layer 209 and a second Al conductive layer 206 are formed. The portion of the Al conductive layer 206 which is the second layer and the TaSiN heater layer 209 outside the bubble forming heater section are formed by photo lithography and dry etching. In the present embodiment, the Al conductive layer 206 and the TaSiN heater layer 209 are formed together in the same process. After this, etching of the Al conductive layer 206 which is the second layer, in only the bubble forming heater section, is performed via photolithography and wet etching, and this section is formed as a bubble forming heater. A SiN protective film 207 is also laminated further above these on the substrate. The ink supply port 210 is formed by laser processing after the above mentioned process has been accomplished.

Figure 15:
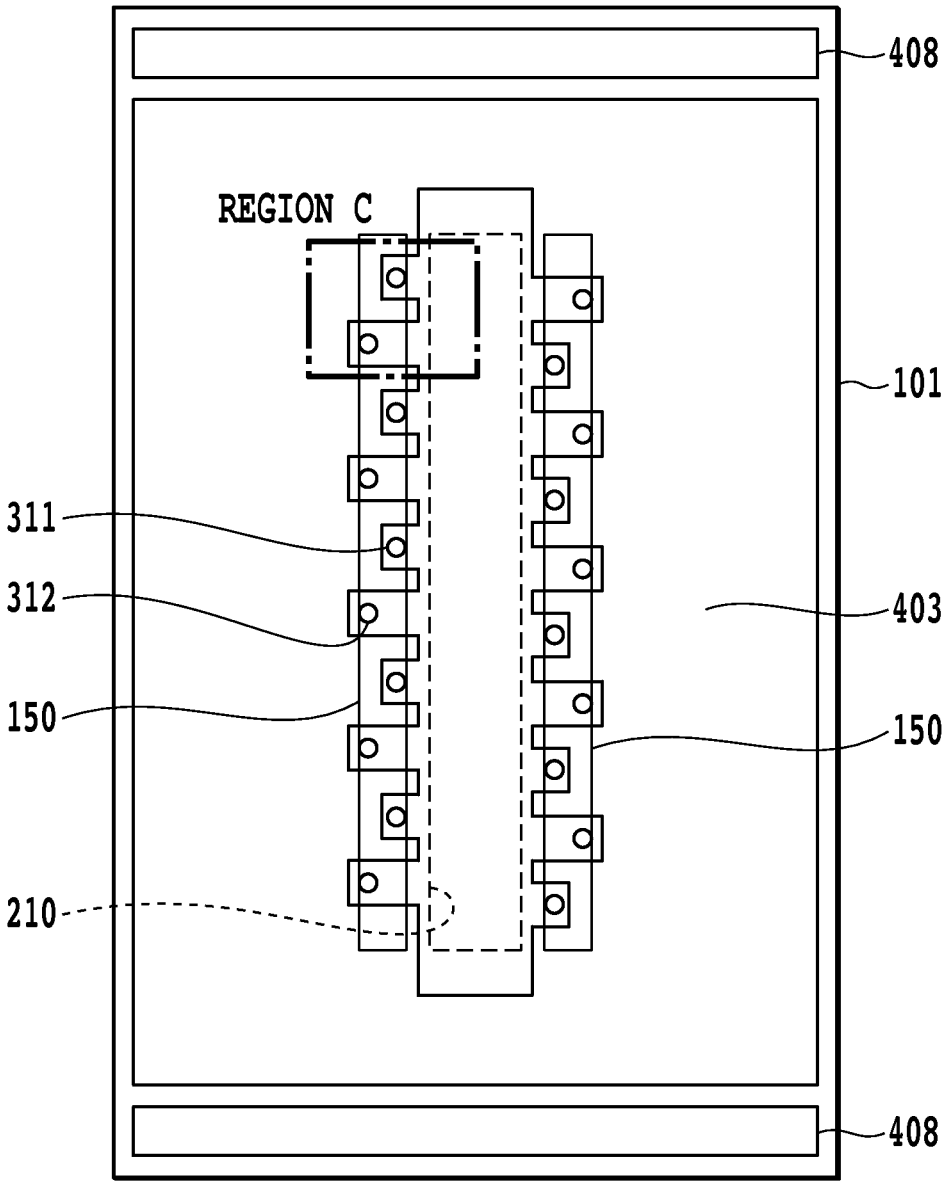
FIG. 15 is a schematic plan view of a print head substrate for explaining the positional relationship between the heater formation region of the print head substrate employed in the print head of FIG. 12 and the ejection openings formed to correspond to the heaters.

FIG. 15 is a schematic plan view, of a print head substrate 101, for explaining the positional relationship between the heater formation region 150 of the print head substrate 101 used in the print head 4 of the present embodiment, and the ejection openings formed to correspond to the heaters 111 and 112. In the area excluding the electrode pad forming region 408 positioned at the end of the print head substrate 101, the print head substrate 101 is joined to the flow path forming member 403 having a wall of the ink flow path. Thus, inside the bubble forming heater formation region 150, while alternately changing the distance from the ink supply port 210, ejection openings 311 and 312 are staggeredly aligned and ejection opening arrays are formed in parallel to the direction in which the ink supply port 210 extends. Also, flow paths 313 and 314, corresponding to each ejection opening 311 and 312 and communicating with the ink supply port 210, are formed by joining the flow path forming member 403 to the print head substrate 101.

Figure 16A:
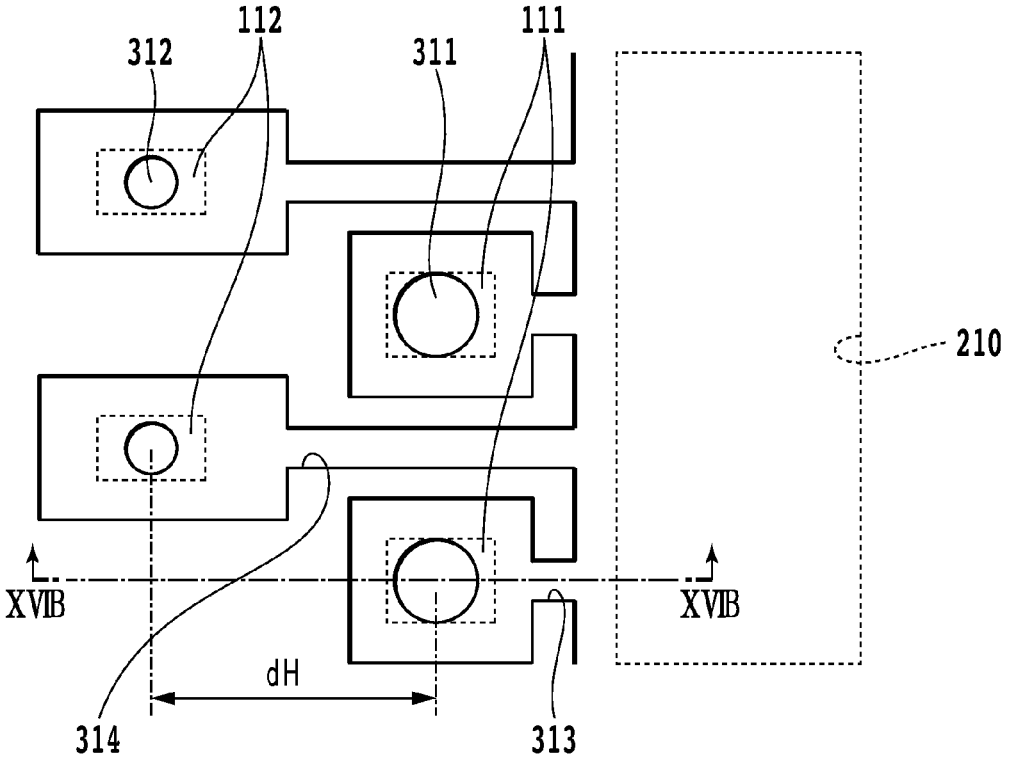
FIG. 16A is an enlarged schematic cross sectional view, of the ink paths of region C of FIG. 15.

FIG. 16A is an enlargement of the region C shown in FIG. 15, and is a schematic plan view, showing ink flow paths 313 and 314, in the vicinity of the heater of the print head 4 of the present embodiment. The print head 4 is formed such that two types of ejection openings 311 and 312 with differing distances from the ink supply port 210 are formed, and ink flow paths 313 and 314 of differing lengths according to the distance from the ink supply port 210 communicate with the ejection openings 311 and 312. In the present embodiment, among these two types of ejection openings, ejection openings at a comparatively short distance from the ink supply port are taken as ejection opening 311 (the first ejection openings). The ink ejection openings at a distance longer than the interval between the ink supply port and the ejection openings 311 are taken as ejection openings 312 (the second ejection openings). Here, the first ejection openings 311 can be used to eject ink drops that are larger than the second ejection openings 312. That is, the opening diameter of the second ejection openings 312 are set smaller than the opening diameter of the first ejection openings 311. Hereinafter, for the sake of convenience, ink drops ejected from the first ejection openings 311 shall be called large liquid drops and ink drops ejected from the second ejection openings 312 shall be called small liquid drops. The ink flow paths extending from the ink supply port 210 to the ejection openings 311 are taken as ink flow paths 313, and the ink flow paths extending from the ink flow path 210 to the ejection openings 312 are taken as ink flow paths 314. A plurality of each of the ejection openings 311 and 312 are formed, and ejection opening arrays are formed therefrom. These ejection opening arrays are formed along the ink supply port 210. In the present embodiment, the first ejection openings 311 at a comparatively short distance from the ink supply port and the second ejection openings 312 at a comparatively long distance from the ink supply port are alternatively formed along the ink supply port 210, and are staggeredly aligned. First bubble forming heaters 111 (first print elements) for ejecting large liquid drops are also formed at positions corresponding to the first ejection openings 311. Second bubble forming heaters 112 (second print elements) for ejecting small liquid drops are formed at positions corresponding to the second ejection openings 312. Thus, viewed from the side from which ink is ejected, the sub-heater 201 is arranged in between the first bubble forming heater 111 and the second bubble forming heater 112, in a band shape such as to surround the perimeter of the ink supply port 210 in the same manner as FIG. 9. That is, when viewing the print head 4 from the side on which the heaters are established, the sub-heater 201 is arranged on the underside of the ink flow path 314 in communication with the second ejection openings 312 and the ink supply port 210.

In this manner, the sub-heater 201, viewed from the side from which ink is ejected, is arranged between a section of multiple bubble forming heaters (print elements) and the ink supply port 210. Here, the section of multiple bubble forming heaters are a section of print elements that are plurally arranged along the ink supply port 210. In the present embodiment, among the bubble forming heaters arranged along the ink supply port 210, one section of multiple print elements are the bubble forming heaters 112 that serve as the second print elements at a comparatively long distance from the ink supply port 210. Also among the multiple print elements, another section, which does not include the one section of multiple print elements, is established in the interval between the sub-heater 201 and the ink supply port 210. The other section that does not include the one section of the multiple print elements is the other print element that does not include the one section of print elements mentioned above among the plurally arranged print elements. In the present embodiment, the other section among the multiple print elements are the bubble forming heaters 111 serving as the first printing element at a comparatively short distance from the ink supply port 210 among the bubble forming heaters formed along the ink supply port 210.

In the present embodiment, because the sub-heater 201 were arranged between the heaters 111 and 112 in this manner, in addition to being able to effectively heat the ink inside the ink supply port 210, it is possible to preliminarily heat the bubble forming heaters 111 and 112 by the sub-heater 201. Therefore, when printing is performed, it is possible for the sub-heater 201 to have already preliminarily heated the bubble forming heaters 111 and 112 to a given temperature. Also, because the diameter of the second ejection opening 312 is smaller than the diameter of the ejection opening 311, there is a high likelihood of the occurrence of an improper ejection in case of high viscosity ink. However, by establishing a sub-heater 201 on the underside of the ink supply path 314 in communication with the second ejection opening 312 for ejecting small liquid drop, reliably heating the ink inside the ink flow path 314 and lowering the ink's viscosity, and it is possible to prevent improper ejection. Also, the sub-heater 201 can effectively heat the ink inside the ink supply port 201 by way of being arranged in a band shape such as to surround three sides of the ink supply port, as shown in FIG. 9.

Figure 16B:
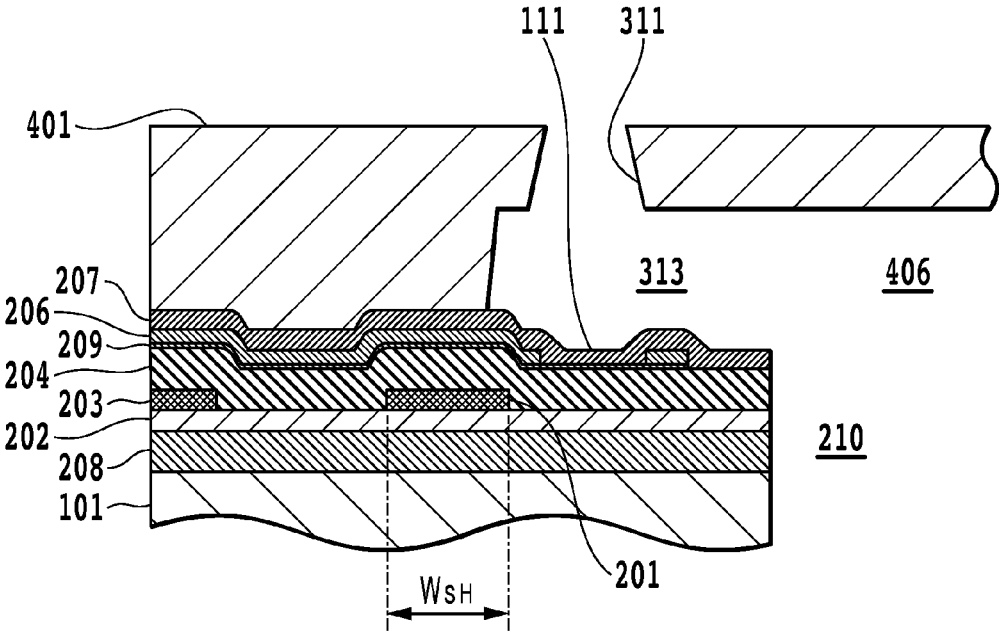
FIG. 16B is a cross sectional view taken along the line XVIB-XVIB of FIG. 16A.

FIG. 16B is a cross sectional view taken along the line XVIB-XVIB of the print head of FIG. 16A. The ejection opening 311 and the ink flow path 313 are formed by the flow path forming member 300, such as to correspond to the heater 111. The distance dH between the centers of each of the bubble forming heaters 111 and 112 is set such as to satisfy the ejection function in consideration of the heater size of the bubble forming heaters 111 (first printing element) and 112 (second printing element), the diameter of the ejection openings 311 (first ejection openings) and 312 (second ejection openings), and the flow path structures of the ink flow paths 313 and 314. Viewed from the side from which ink is ejected, by arranging the sub-heater 201 behind the bubble forming heaters 111, 112 in the direction of ink ejection, in the electric circuit functionally dead space between the bubble forming heaters 111 and 112, it is possible to attain miniaturization of the print head substrate 101. Furthermore, according to the print head 4 of the present embodiment, in addition to temperature regulation of the ink stored inside the ink supply port 210 by the sub-heater 201, it is possible to preliminarily heat the two bubble forming heaters 111 and 112, and it is possible to attain stabilization of print images.

In the print head of the present embodiment, the distance dH' between the edges of the bubble forming heaters is 32 μm. Also, the width WsH of the sub-heater 201 is 28 μm. By using the print head 4 of the present embodiment, compared to print heads in the prior art, which do not utilize the present invention, it was possible to reduce the width We of the substrate approximately 4% from 1420 μm to 1364 μm.

The fifth embodiment will be explained next using FIG. 17. It should be noted that the figures will be coded in the same manner and explanations omitted with respect to sections that are configured in the same manner as the first through fourth embodiments above, and explanations will be given only with respect to sections that differ. It is the same as FIG. 16 with respect to the relationship between the ejection openings and the printing elements.

Figure 17:
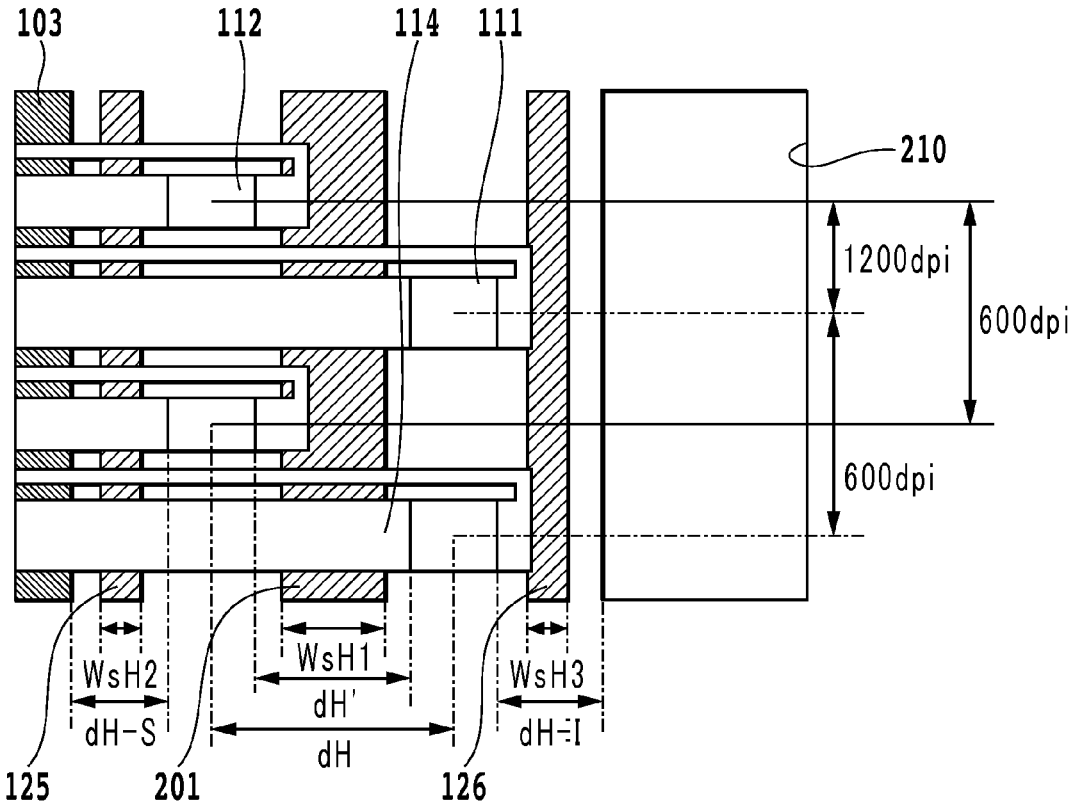
FIG. 17 is an enlarged schematic plan view, in the area of periphery of the sub-heaters, of a print head substrate in the print head of a fifth embodiment of the present invention, for explaining the position of the sub-heaters.

FIG. 17 shows an enlarged schematic plan view, showing the wiring section of the bubble forming heaters and sub-heaters of the print head of the fifth embodiment. Also in the present embodiment, a first sub-heater 201 is set up in the area between the staggeredly aligned first ejection openings 311 and second ejection opening 312. In addition, a second sub-heater 126 is formed in the area between the ink supply port 210 and the first ejection openings 311, and a third sub-heater 125 is formed outside the second ejection opening 312 further away from the ink supply port 210. That is, when viewing the print head 4 from the side on which the heater is established, a second sub-heater 126 is established on the underside of the ink flow path 313 in communication with the first ejection openings 311 and the ink supply port 210. Furthermore, the first sub-heater 201 and the second sub-heater 126 are set up on the underside of the ink flow path 314 in communication with the second ejection openings 312 and the ink supply port 210. In the present embodiment as well, the opening diameter of the second ejection openings 312 are set smaller than the opening diameters of the first ejection openings 311, and ink drops ejected from the second ejection openings 312 are smaller than ink drops ejected from the first ejection openings 311.

As shown in FIG. 17, the switching element 103 is arranged at a location that is further away from the ink supply port than the ejection openings 312 that are formed at a location comparatively away from the ink supply port 210. Thus, a third sub-heater 125 (an outer side preliminary heating heat generation element) is arranged between the bubble forming heaters 112 formed at locations corresponding to the ejection openings 312 and the switching element 103. Also, a second sub-heater 126 (an inner side preliminary heating heat generation element) is formed as an additional sub-heater between the ink supply port 210 and the bubble forming heaters 111 formed at locations comparatively close to the ink supply port 210.

Here, the distance between the respective centers of each of the bubble forming heaters 111 and 112 is taken as dH. Again, the distance between the edges of the heaters 111 and 112 that are on the mutually closest side to each other is taken as dH'. The width of the bubble forming heater is again taken as WsH1. Here, in the print head of the present embodiment as well, the heaters are formed such that the heater width WsH1 of the sub-heater 201 formed between the bubble forming heater arrays satisfies the relationship dH'>WsH1. Also, in the print head substrate 101 of the print head of the present embodiment, by reason of heater electrode routing, the distance dH-s of the interval between the edges of the switching element 103 and the bubble forming heaters 112 is widened when compared to the fourth embodiment. Also, by reason of the processing accuracy and the like the upon formation of the ink supply port 210, the distance dH-I of the interval between the edge of the ink supply port 210 and the edge of the bubble forming heater 111 is widened compared to that of the fourth embodiment. The third sub-heater 125, formed at a position away from the ink supply port, is arranged between the bubble generating heater 112 and the switching element 103 such that the width WsH2 satisfies the relationship dH-S>WsH2. Also, the second sub-heater 126 formed at a position near the ink supply port is arranged between the bubble generating heater 111 and ink supply port 210 such that the width WsH3 satisfies the relationship dH-I>WsH3.

In this manner, in the fourth embodiment, in addition to the heater formed between the bubble forming heaters 111 and 112, sub-heaters 125 and 126 are arranged in areas outside of the space between the heater arrays. In doing so, for each region on the print head substrate 101, it is possible to more finely establish preliminary heating temperature control due to the sub-heaters 201, 125, and 126, and more effectively perform preliminary heating in order to reduce ink viscosity. Again, as for the diameter of the second ejection opening 312, because it is smaller than the diameter of the first ejection opening 311, when ink viscosity is high the probability of an occurrence of an ink ejection defect is high. However, a first sub-heater 201 and a second sub-heater 126 are provided at the underside of the ink flow path 314 in communication with the second ejection openings 312 for ejecting small drop. Because of this it is possible to reliably heat the ink inside the flow path 314, and prevent ejection defects due to lowering of ink viscosity.

Also, because the sub-heaters 201, 126, and 125 are arranged in a band shape such as to surround the perimeter of the ink supply port 201 as shown in FIG. 9, it is possible to uniformly heat the ink of the ink supply port 201.

The sixth embodiment will be explained next using FIG. 18. It should be noted that the figures will be coded in the same manner and explanations omitted with respect to sections that are configured in the same manner as the first through fifth embodiments above, and explanations will be given only with respect to sections that differ. The relationship between the ejection openings and the print elements is the same as that of FIG. 16.

Figure 18:
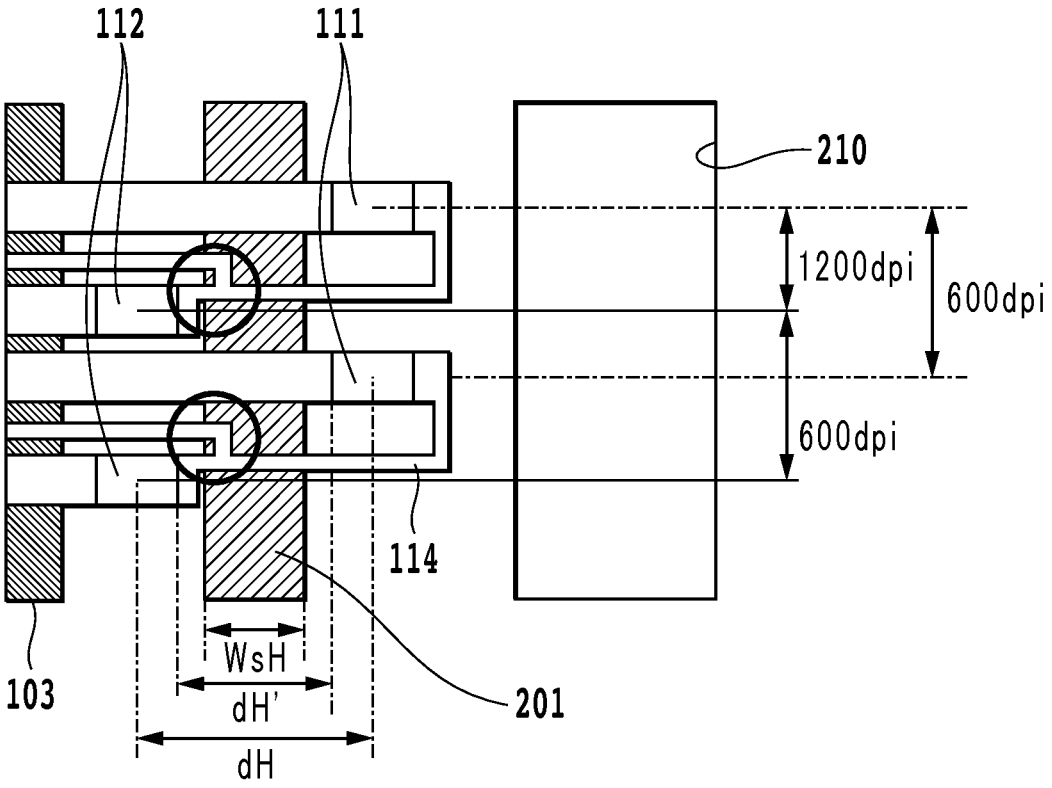
FIG. 18 is an enlarged schematic plan view, in the area of periphery of the sub-heaters, of a print head substrate in the print head of a sixth embodiment of the present invention, for explaining the position of the sub-heaters.

FIG. 18 shows an enlarged schematic plan view, showing the wiring section of the bubble forming heaters and sub-heaters of the print head of the sixth embodiment. As for the neighboring bubble forming heaters 111 and 112, which are at distances that differ from the ink supply port, the respective heaters are arranged such that, taking the centers of the respective bubble forming heaters as a reference, the interval dH takes up the space between the centers of the heaters 111 and 112. With respect to the distance dH' between the edges of the mutually closest side of each bubble forming heater, the sub-heater 201 is arranged such that the width WsH satisfies the relationship dH'>WsH between the arrays of the bubble forming heaters. As for the substrate of the present embodiment, for wiring efficiency reasons, apart of the bubble forming heater conductive layer 114 is shared between the two types of heaters that have a varying distance from the ink supply port. Thus the print head is formed such that the bubble forming heater conductive layer 114 is connected in the area above the sub-heater 201, in relation to the direction of liquid ejection. It should be noted that the direction of liquid ejection denotes the direction perpendicular to the print head substrate of the present embodiment. It should be noted that also in the present embodiment the first ejection openings 311 can be used for ejecting ink drops larger than the second ejection openings 312. That is, the opening diameter of the second ejection openings 312 are set smaller than the opening diameters of the first ejection openings 311.

The coupled portion of the conductive layer that is connected to the bubble forming heaters is formed at a location corresponding to the sub-heater. As for the present invention, the conductive layer connected to the bubble forming heaters is connected towards to forward direction of the sub-heater's ink ejection direction.

In this manner, the conductive layer connected to the bubble forming heaters at different distances from the ink supply ports is connected at an area above the preliminary heating sub-heater, and it is possible to effectively use the space within the print head substrate. Therefore it is possible to attain miniaturization of the ink jet print head substrate, and it is possible to attain reduction of the manufacturing costs.

It should be noted that the liquid ejection head of the present invention can be mounted in apparatus such as printers, photocopying machines, facsimiles that have a communication system, and word processors that have a printer, and also in all sorts of processing apparatus and complexly combined industry print apparatus. By using this liquid ejection head, it is possible to perform printing on a variety of printing mediums such as paper, thread, fiber, cloth, hide, metal, plastic, glass, wood, ceramics, and the like. It should be noted that "printing" as used in the specification means not only the creation of images on a print medium that carry the meaning of characters, figures and the like, but also means the creation of images that do not carry a meaning of a patterns or the like.

Furthermore, "ink" and "liquid" should be broadly interpreted, and defined as liquid supplied for images, designs, formations of patterns and the like, processing of print medium, or treatment of the ink or the print medium. Here, treatment of the ink or print medium, are called things such as, for example, the improvement of fixability by means of coagulation or insolubility of the coloring material inside the ink imparted on the print medium, or improvement of print quality, coloring and improvement of image permanence.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-113622, filed May 8, 2009, which is hereby incorporated by reference herein in its entirety.

What is claimed is:

1. A liquid ejection head, comprising:

a liquid ejection head substrate, having a front face having a plurality of first print elements for generating energy for ejecting liquid from first ejection openings and a plurality of second print elements for generating energy for ejecting liquid from second ejection openings, and provided with a supply port for supplying liquid from a back face through the front face;

a flow path forming member having a plurality of liquid flow path walls in communication with the supply port and each of the ejection openings of the plurality of the first ejection openings and the plurality of the second ejection openings, and forming the flow paths by being connected to the liquid ejection head substrate; and a heating element, for heating the liquid ejection head, provided so as to surround the supply port, wherein, viewed from a direction perpendicular to the front face, the plurality of first print elements are positioned between the heating element and the supply port, and the plurality of second print elements are positioned at positions farther from the supply port than the heating element is positioned from the supply port.

2. The liquid ejection head of claim 1, wherein the first print elements and the second print elements are alternately established along the supply port.

3. The liquid ejection head of claim 1, wherein opening diameters of the second ejection openings are smaller than opening diameters of the first ejection openings.

4. The liquid ejection head of claim 3, wherein a volume of each of liquid drops ejected from the second ejection openings is less than a volume of each of liquid drops ejected from the first ejection openings.

5. The liquid ejection head of claim 3, wherein, viewed from the direction perpendicular to the front face, another heating element is further provided on the liquid ejection head substrate, between the supply port and the first print elements so as to surround the supply port.

6. The liquid ejection head of claim 5, wherein, viewed from the direction perpendicular to the front face, the flow paths are established above at least the heating element or the other heating element.

7. The liquid ejection head of claim 5, wherein the plurality of flow paths are divided into a plurality of first flow paths in communication with the supply port and each of the plurality of first ejection openings and a plurality of second flow paths in communication with the supply port and each of the plurality of second ejection openings, the heating element is used to heat liquid inside the supply port and liquid inside the plurality of second flow paths and the other heating element is used to heat liquid inside the supply port, liquid inside the plurality of first flow paths, and liquid inside the plurality of second flow paths.

8. A liquid ejection head, comprising:

a surface having a first ejection opening and a second ejection opening;

a supply port communicated with the first ejection opening and the second ejection opening;

a first print element for generating energy for ejecting liquid from the first ejection opening;

a second print element for generating energy for ejecting liquid from the second ejection opening, the second print element provided at a position farther from the supply port than the first print element is from the supply port and at a same side as the first print element relative to the supply port; and a heating element for heating the liquid ejection head, the heating element provided at a position farther from the supply port than the first print element is from the supply port and closer to the supply port than the second print element is to the supply port so that the heating element extends between the first print element and the second print element, viewed from a direction perpendicular to the surface.

9. The liquid ejection head of claim 8, further comprising:

a first flow path communicating between the first ejection opening and the supply port; and a second flow path communicating between the second ejection opening and the supply port, wherein the heating element and the second flow path partly overlap each other, viewed from the direction perpendicular to the surface.

10. The liquid ejection head of claim 8, further comprising:

a plurality of first print elements; and a plurality of second print elements, wherein the first print elements and the second print elements are alternately provided along a side of the supply port.

11. The liquid ejection head of claim 8, wherein an opening diameter of the second ejection opening is smaller than an opening diameter of the first ejection opening.

12. The liquid ejection head of claim 8, wherein the heating element is provided along a side of the supply port.

13. The liquid ejection head of claim 8, wherein another heating element for heating the liquid ejection head is provided between the supply port and the first print element when viewed from the direction perpendicular to the surface.

* * * * *